US009396915B2

(12) United States Patent
Platt et al.

(10) Patent No.: US 9,396,915 B2
(45) Date of Patent: Jul. 19, 2016

(54) TECHNIQUES FOR AUTOMATED INSTALLATION TESTING AND REPORTING FOR ANALYTICAL INSTRUMENTS

(71) Applicant: WATERS TECHNOLOGIES CORPORATION, Milford, MA (US)

(72) Inventors: Ian Thomas Platt, Billinge (GB); Timothy Charles Ruck, Congleton (GB); Almas Khan, Rochdale (GB); Christopher John Porter, Culcheth (GB)

(73) Assignee: Waters Technologies Corporation, Milford, MA (US)

( * ) Notice: Subject to any disclaimer, the term of this patent is extended or adjusted under 35 U.S.C. 154(b) by 830 days.

(21) Appl. No.: 13/690,249

(22) Filed: Nov. 30, 2012

(65) Prior Publication Data

US 2013/0151190 A1 Jun. 13, 2013

Related U.S. Application Data

(60) Provisional application No. 61/569,418, filed on Dec. 12, 2011.

(51) Int. Cl.
*H01J 49/26* (2006.01)
*H01J 49/00* (2006.01)

(52) U.S. Cl.
CPC ..... *H01J 49/0009* (2013.01)

(58) Field of Classification Search
CPC ... H01J 49/0009; H01J 49/00; H01J 49/0027; H01J 49/0031; H01J 49/26; H01J 49/34
See application file for complete search history.

(56) References Cited

U.S. PATENT DOCUMENTS 6,974,951 B1 * 12/2005 Kingston ..... H01J 49/0031 250/281
8,119,981 B2 * 2/2012 Powell ..... H01J 49/10 250/281

(Continued)

FOREIGN PATENT DOCUMENTS

WO WO 2013/039772 3/2013

OTHER PUBLICATIONS

Varian,"Software Operation Manual." 500-MS IT Mass Spectrometer MS Workstation. Version 6. ©Varian, Inc. 2009.*

*Primary Examiner* — Toan Le
(74) *Attorney, Agent, or Firm* — Muirhead and Saturnelli, LLC

(57) ABSTRACT

Automated installation processing of a mass spectrometer is described. Software is executed providing a user interface for controlling the installation process. Manual setup operations in connection with physical installation of the mass spectrometer are performed. Instrument level testing of the mass spectrometer is performed. The instrument level testing includes automating execution of a first test sequence in response to a first user interface selection. The first test sequence includes one or more performance tests whereby mass spectral data characterizing observed performance of the mass spectrometer is compared to predetermined performance criteria. System level testing of functionality of the mass spectrometer in combination with one or more other components is performed upon successful completion of said instrument level testing. The system level testing includes automating execution of a second test sequence in response to a second user interface selection. System level testing is performed after successful completion of instrument level testing.

22 Claims, 22 Drawing Sheets

(56) References Cited

U.S. PATENT DOCUMENTS

2002/0195555 A1* 12/2002 Weinberger ..... H01J 49/164 250/281
2008/0201095 A1* 8/2008 Yip ..... H01J 49/0009 702/85
2009/0194681 A1* 8/2009 McCauley ..... H01J 49/426 250/282
2010/0042351 A1* 2/2010 Covey ..... G01N 15/1404 702/108
2014/0239171 A1 8/2014 Platt et al.
2015/0206728 A1* 7/2015 Kaneko ..... H01J 49/0027 250/282

* cited by examiner

1300

2100

High Mass Resolution, Positive Ion, MS1 and MS2

2102 Resolution is measured using a 10 μL/min infusion of Xevo TQ-S setup solution. The valley between the 2034.63 Da and 2035.63 Da peaks is <12% of the average height of the two peaks.

☐ Yes ☐ No ☐ N/A _____

MS1 resolution: _____

MS2 resolution: _____

The valley is <12% of the average height of the two peaks.

☐ Yes ☐ No ☐ N/A _____

FIGURE 12D

TABLE 1 - Part 1

| Class Name | Usage | Description |
|---|---|---|
| MLAcquireClass Class | Within individual test classes. | Responsible for interfacing with MassLynx to start and monitor the acquisition of mass spectral data. |
| MLDataClass Class | Within individual test classes. | Responsible for the processing of acquired data in general terms Contains methods for extracting MassLynx spectral and chromatographic data and manipulating the data to make a measurement |
| EPCUtilities Class | One instance created at the main thread level and referenced by individual tests. | Responsible for the low level control of the mass spectrometer including setting instrument parameters and obtaining instrument readings (voltages and pressures for example). |
| LogFileClass Class | Used in the WEAT Base class inherited by instrument base classes, an instance of which is created at the main thread level. Referenced by individual tests. | Responsible for recording results and comments in XML format during a testing process. |

FIG. 19A

TABLE 1 - Part 2

| Class Name | Usage | Description |
|---|---|---|
| HelpFileViewer<br>Class<br>Form | Used in the WEAT Base class inherited by instrument base classes, an instance of which is created at the main thread level. Referenced by individual tests. | Responsible for the display of additional information in HTML format. This is a web browser as may be used internally by a software application . |
| WEATSecurity<br>Class | Used in the WEAT Base class inherited by instrument base classes, an instance of which is created at the main thread level. | Responsible for providing a monthly updating password to provide the secure aspect of the software. |
| StatusProvider<br>Abstract Class | Inherited by automation tests and utilities | Provides a range of properties that may be used to display status, results or information to a user interface |
| AutomationUtilit...<br>Class<br>StatusProvider | Inherited by all individual automation utilities | Extends the status provider abstract class to provide logging functions using the LogFileClass. |
| AutomationTest<br>Class<br>StatusProvider | Inherited by all individual automation tests. | Extends the utility to provide a results array and diagnostic extensions. |

FIG. 19B

TABLE 2

| Class Name | Usage | Description |
|---|---|---|
| TQBaseClass<br>Class<br>+ WEATBaseClass | One instance created at the main thread level and includes methods and public fields referenced by individual tests. The may be either directly implemented or implemented in a derived class. | Inherits from the WEAT base class to provide basic security, log file and browser support. There is always one instance of the WEATBaseClass derived class in an automation user interface to retain functions common to automation packages. |
| ResolutionTest<br>Class<br>+ AutomationTest | Example test, one instance (inheriting from the Automation test class) created at the main thread level. Methods of the ResolutionTest may be invoked as part of a workflow or as a standalone procedure. | Example test uses MLAcquire and MLData to acquire spectral data and measure the width of 5 spectral peaks across a defined mass range. The data is checked against width and linearity thresholds. |
| GainTest<br>Class<br>+ AutomationTest | Example test, one instance (inheriting from the Automation test class) created at the main thread level. Methods of GainTest may be invoked as part of a workflow or as a standalone procedure. | Example test uses MLAcquire and MLData to acquire spectral data and measure the intensity of 5 spectral peaks across a defined mass range. The data is checked against intensity thresholds. |
| CalFileChecker<br>Class<br>+ AutomationUtility | Example test, one instance (inheriting from the Automation utility class) created at the main thread level. Methods of CalFileChecker may be invoked as part of a workflow or as a standalone procedure. | Example utility identifies a list of calibration files associated with an instrument for information only. |

FIG. 20

TECHNIQUES FOR AUTOMATED INSTALLATION TESTING AND REPORTING FOR ANALYTICAL INSTRUMENTS

RELATED APPLICATION(S)

This application claims priority to U.S. Provisional Application No. 61/569,418, filed Dec. 12, 2011, which is incorporated by reference herein.

TECHNICAL FIELD

This application generally relates to techniques for use with analytical or scientific instruments and more particularly to automated installation testing and/or reporting in connection with installation of analytical or scientific instruments.

BACKGROUND INFORMATION

Analytical or scientific instruments may be used in connection with sample analysis. Such instruments may include, for example, an instrument system that performs mass spectrometry, liquid chromatography, gas chromatography, and the like. In connection with such instruments, the installation process typically includes manual mechanical operations to set up the instrument being installed. For example, in connection with installation of a mass spectrometer, the manual operations in connection installation may include unpacking instrument components, the physical setup of the instrument at a customer site where the instrument will be utilized, connecting instrument components to any required power supply, and the like. Once the instrument is physically set up, the installation process may continue with manually performing installation tests to optimize and/or test installed instrument functionality. Such installation testing is typically performed manually and successful completion of such tests ensures that the instrument's performance and/or operation are acceptable after completion of the manual mechanical setup. However, such manual installation testing may have drawbacks. Typically, a highly skilled and qualified technician is required to perform such installation testing. Additionally, the manual testing may be inconsistently performed across instruments thereby leading to inconsistent results regarding instrument performance after completion of the manual setup. Furthermore, performing the testing manually as well gathering and analyzing test results manually may be time consuming, cumbersome and error prone.

SUMMARY OF THE INVENTION

In accordance with one aspect of the invention is a method of performing installation processing for installing a mass spectrometer, the method comprising: executing software providing a user interface for controlling an installation process of the mass spectrometer; completing one or more manual setup operations in connection with physical installation of the mass spectrometer; performing instrument level testing of the mass spectrometer, wherein said instrument level testing includes automating execution of a first test sequence in response to a first user interface selection, said first test sequence including one or more performance tests whereby mass spectral data characterizing observed performance of the mass spectrometer is compared to predetermined performance criteria; and performing system level testing of functionality of the mass spectrometer in combination with one or more other components upon successful completion of said instrument level testing, wherein said system level testing includes automating execution of a second test sequence in response to a second user interface selection, wherein said system level testing is performed after successful completion of said instrument level testing. After completing the one or more manual setup operations, the method may further comprise performing processing including: selecting one or more items from the user interface to indicate completion of the one or more manual setup operations; selecting a third user interface selection after completing said selecting of the one or more items; and determining, in response to the third user interface selection, whether required manual setup operations have been completed based on which of said one or more items corresponding to one or more manual set up operations have been selected. The method may also include performing option level testing of one or more optional components of the mass spectrometer, wherein said option level testing is performed after successful completion of said system level testing. Each of the first test sequence and the second test sequence may include any of an informational test and a critical threshold test. Responsive to a failure of a critical threshold test in any of the first test sequence and the second test sequence, processing may include the test sequence terminating, a remedial action in accordance with the failed critical threshold test may be performed, and execution of the test sequence may resume with reperforming the failed critical threshold test or with reperforming another test previously successfully performed prior to the failed critical threshold test. A first test that is included in the test sequence and is subsequent to the critical threshold test in the test sequence may generate first test results, said first test being dependent upon test results of the critical threshold test. Validity of the first test results may depend on having a successful test result of the critical threshold test. Each of the first test sequence and the second test sequence may specify a predetermined order in which a plurality of tests are performed. A liquid chromatography instrument may be coupled to the mass spectrometer and sample output from the liquid chromatography instrument may be input to the mass spectrometer for analysis. The system level testing may include testing functionality based on a combination of the liquid chromatography instrument and the mass spectrometer. The system level testing may include performing a gradient performance test whereby the liquid chromatography instrument varies concentrations of solvents during a first run and during a second run. The method may include comparing first mass spectral data acquired from the first run to second mass spectral data acquired during the second run; determining whether any difference between the first mass spectral data and the second mass spectral data are within an acceptable threshold; determining that the gradient performance test fails if any difference between the first and the second mass spectral data is not within the acceptable threshold, and otherwise determining that the gradient performance test passes. A first set of retention times of a plurality of compounds in the first mass spectral data may be compared to a second set of corresponding retention times of the plurality of compounds in the second mass spectral data. If the gradient performance test fails, it may be determined to take a remedial action on the liquid chromatography instrument and, subsequent to performing the remedial action, the system level testing may resumes with reperforming the gradient performance test. The method may include saving installation status information characterizing a current state of installation processing for the mass spectrometer, said status information enabling resuming execution of the installation processing at a subsequent point in time. The instrument level testing may include performing a performance test related to peak width and resolution, peak position indicating a mass position, and intensity. Upon failure of a system level test included in the system level testing, a remedial action may be performed, and the installation processing may resume with testing at a point in any of the instrument level testing and the system level testing in accordance with the remedial action performed. Upon failure of an option test included in the option level testing, a remedial action may be performed and the installation processing may resume with testing at a point in any of the option level testing, the instrument level testing and the system level testing in accordance with the remedial action performed. Commands to perform the system level testing and the instrument level testing may be issued over a network connection to the mass spectrometer from a computer system remotely located with respect to the mass spectrometer. Responsive to successful completion of the instrument level testing, a first user interface item selected in connection with the first user interface selection may be disabled and a second user interface item selected in connection with the second user interface selection may be enabled.

In accordance with another aspect of the invention is a computer readable medium comprising code stored thereon for performing installation processing for installing a mass spectrometer, the computer readable medium comprising code, which when executed, performs processing including: providing a user interface for controlling an installation process of the mass spectrometer; indicating via the user interface that one or more manual setup operations are to be completed in connection with physical installation of the mass spectrometer; performing instrument level testing of the mass spectrometer, wherein said instrument level testing includes automating execution of a first test sequence in response to a first user interface selection, said first test sequence including one or more performance tests whereby mass spectral data characterizing observed performance of the mass spectrometer is compared to predetermined performance criteria; and performing system level testing of functionality of the mass spectrometer in combination with one or more other components upon successful completion of said instrument level testing, wherein said system level testing includes automating execution of a second test sequence in response to a second user interface selection, wherein said system level testing is performed after successful completion of said instrument level testing. The computer readable medium may further comprise code for performing other processing after completing the one or more manual setup operations, where the other processing may include selecting one or more items from the user interface to indicate completion of the one or more manual setup operations; selecting a third user interface selection after completing said selecting of the one or more items; and determining, in response to the third user interface selection, whether required manual setup operations have been completed based on which of said one or more items corresponding to one or more manual set up operations have been selected. The computer readable medium may further comprise code for performing option level testing of one or more optional components of the mass spectrometer, wherein said option level testing is performed after successful completion of said system level testing.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the techniques described herein.

FIGS. 2-9B, 12C and 12D are examples of screenshots illustrating information as may be displayed in connection with a user interface in an embodiment in accordance with techniques herein;

FIGS. 19A and 19B are an example of a table, TABLE 1, of classes that may be used in an embodiment in accordance with techniques herein; and FIG. 20 is an example of a table, TABLE 2, of classes in the instrument level derived class library that may be used in an embodiment in accordance with techniques herein.

DESCRIPTION

As used herein, the following terms generally refer to the indicated meanings:

"Chromatography"—refers to equipment and/or methods used in the separation of chemical compounds. Chromatographic equipment typically moves fluids and/or ions under pressure and/or electrical and/or magnetic forces. The word "chromatogram," depending on context, herein refers to data or a representation of data derived by chromatographic means. A chromatogram can include a set of data points, each of which is composed of two or more values; one of these values is often a chromatographic retention time value, and the remaining value(s) are typically associated with values of intensity or magnitude, which in turn correspond to quantities or concentrations of components of a sample.

Retention time—in context, typically refers to the point in a chromatographic profile at which an entity reaches its maximum intensity.

Ions—A compound, for example, that is typically detected using a mass spectrometer (MS) appears in the form of ions in data generated as a result of performing an experiment such as with an MS in combination with a liquid chromatography (LC) system (e.g., LC/MS) or a gas chromatography (GC) system (e.g., GC/MS). An ion has, for example, a retention time and an m/z value. The LC/MS or GC/MS system may be used to perform experiments and produce a variety of observed measurements for every detected ion. This includes: the mass-to-charge ratio (m/z), mass (m), the retention time, and the signal intensity of the ion, such as a number of ions counted.

A mass chromatogram may refer to a chromatogram where the x-axis is a time-based value, such as retention time, and the y-axis represents signal intensity such as of one or more ion masses.

A mass spectrum or spectrum may refer to a mass spectral plot such as of a single scan time of ion intensity vs. mass or m/z.

Generally, an LC/MS or GC/MS system may be used to perform sample analysis and may provide an empirical description of, for example, a protein or peptide as well as a small molecule in terms of its mass, charge, retention time, and total intensity. When a molecule elutes from a chromatographic column, it elutes over a specific retention time period and reaches its maximum signal at a single retention time.

After ionization and (possible) fragmentation, the compound appears as a related set of ions. In an LC/MS separation, a molecule may produce a single or multiple charged states. MS/MS may also be referred to as tandem mass spectrometry which can be performed in combination with LC separation (e.g., denoted LC/MS/MS).

Figure 1:
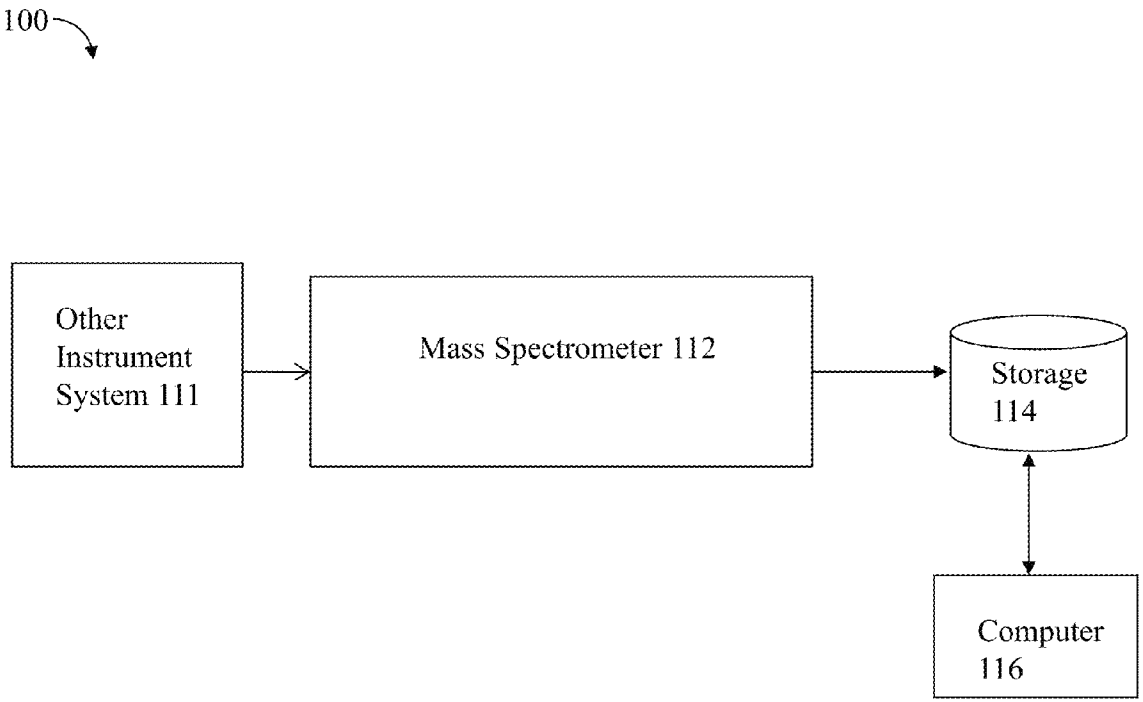
FIG. 1 is a block diagram of a system, in accordance with one embodiment of the techniques herein.

Referring to FIG. 1, shown is an embodiment of a system in accordance with techniques herein. The system 100 may include a mass spectrometer (MS) 112, other instrument system 111, storage 114 and a computer 116. The other instrument system 111 may be, for example, an LC or GC system, which interfaces with the MS 112 in connection with sample analysis. As known to those of ordinary skill in the art, the system 100 may be used to perform analysis of a sample for detection, identification and/or quantification of one or more compounds of interest. A chromatographic separation technique, such as by an LC, may be performed prior to injecting the sample into the MS 112. Chromatography is a technique for separating compounds, such as those held in solution, where the compounds will exhibit different affinity for a separation medium in contact with the solution. As the solution flows through such an immobile medium, the compounds separate from one another. As noted above, common chromatographic separation instruments that may serve as the other instrument system 111 include an instrument that performs GC or LC which, when coupled to a mass spectrometer, may be referred to respectively as a GC/MS or an LC/MS system. GC/MS or LC/MS systems are typically on-line systems in which the output of the GC or LC 111 is coupled directly to the MS 112 for further analysis.

During analysis by the MS 112, molecules from the sample are ionized to form ions. A detector of the MS 112 produces a signal relating to the mass of the molecule and charge carried on the molecule and a mass-to-charge ratio (m/z) for each of the ions is determined. Although not illustrated in FIG. 1, the MS 112 may include components such as a desolvation/ionization device, collision cell, mass analyzer, detector, and the like. In an LC/MS system, a sample is injected into the liquid chromatograph at a particular time. The liquid chromatograph causes the sample to elute over time resulting in an eluent that exits the liquid chromatograph. The eluent exiting the liquid chromatograph is continuously introduced into the ionization source of the MS 112. As the separation progresses, the composition of the mass spectrum generated by the MS evolves and reflects the changing composition of the eluent. Typically, at regularly spaced time intervals, a computer-based system samples and records the spectrum. The response (or intensity) of an ion is the height or area of the peak as may be seen in the spectrum. The spectra generated by conventional LC/MS systems may be further analyzed. Mass or mass-to-charge ratio estimates for an ion are derived through examination of a spectrum that contains the ion. Retention time estimates for an ion are derived by examination of a chromatogram that contains the ion.

Two stages of mass analysis (MS/MS also referred to as tandem mass spectrometry) may also be performed. For example, one particular mode of MS/MS is known as product ion scanning where parent or precursor ions of a particular m/z value are selected in the first stage of mass analysis by a first mass filter/analyzer. The selected precursor ions are then passed to a collision cell where they are fragmented to produce product or fragment ions. The product or fragment ions are then mass analyzed by a second mass filter/analyzer.

Mass analyzers of the MS 112 can be placed in tandem in a variety of ion optical configurations, including, e.g., quadrupole mass analyzers, time of flight mass analyzers and magnetic sector mass analyzers. A tandem configuration enables on-line collision modification and analysis of an already mass-analyzed molecule. For example, in triple quadrupole based mass analyzers (such as Q1-Q2-Q3), the second quadrupole (Q2) imparts accelerating voltages to the ions separated by the first quadrupole (Q1). These ions collide with a gas molecules or ions expressly introduced into Q2. The originally selected analyte ions fragment as a result of these collisions. Those fragments are further analyzed by the third quadrupole (Q3). For example, the Xevo™ TQ Mass Spectrometer and the Xevo™ TQ-S Mass Spectrometer, both by Waters Corporation of Milford Mass., are examples of triple quadrupole mass spectrometers.

As an output, the MS 112 generates a series of spectra or scans collected over time. A mass-to-charge spectrum or mass spectrum is ion intensity plotted as a function of m/z or mass. Each element, a single mass or single mass-to-charge ratio, of a spectrum may be referred to as a channel. Viewing a single channel over time provides a chromatogram for the corresponding mass or mass-to-charge ratio. The generated mass-to-charge spectra or scans can be acquired and recorded on a storage medium such as a hard-disk drive or other storage media represented by element 114 that is accessible to computer 118. Typically, a spectrum or chromatogram is recorded as an array of values and stored on storage 114. The spectra stored on 114 may be accessed using the computer 116 such as for display, subsequent analysis, and the like. A control means (not shown) provides control signals for the various power supplies (not shown) which respectively provide the necessary operating potentials for the components of the system 100 such as the MS 112. These control signals determine the operating parameters of the instrument. The control means is typically controlled by signals from a computer or processor, such as the computer 116.

In an embodiment in which the element 111 represents an LC instrument as known in the art, a molecular species migrates through a column of the LC and emerges, or elutes, from the column at a characteristic time. This characteristic time commonly is referred to as the molecule's retention time. Once the molecule elutes from the column, it can be conveyed to the MS 112. A retention time is a characteristic time. That is, a molecule that elutes from a column at retention time t in reality elutes over a period of time that is essentially centered at time t. The elution profile over the time period is referred to as a chromatographic peak. The elution profile of a chromatographic peak can be described by a bell-shaped curve. The peak's bell shape has a width that typically is described by its full width at half height, or half-maximum (FWHM). The molecule's retention time is the time of the apex of the peak's elution profile. Spectral peaks appearing in spectra generated by mass spectrometers have a similar shape and can be characterized in a similar manner.

The storage 114 may be any one or more different types of computer storage media and/or devices. As will be appreciated by those skilled in the art, the storage 114 may be any type of computer-readable medium having any one of a variety of different forms including volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, (DVD) or other optical storage, magnetic cassettes, magnetic tape, magnetic disk storage or other magnetic storage devices, or any other medium which can be used to store the desired code, data, and the like, which can accessed by a computer processor.

The computer 116 may be any commercially available or proprietary computer system, processor board, ASIC (application specific integrated circuit), or other component which includes a computer processor configured to execute code stored on a computer readable medium. The processor, when executing the code, may cause the computer system 116 to perform processing steps such as to access and analyze the data stored on storage 114. The computer system, processor board, and the like, may be more generally referred to as a computing device. The computing device may also include, or otherwise be configured to access, a computer readable medium, such as represented by 114, comprising executable code stored thereon which cause a computer processor to perform processing steps.

In connection with analytical or scientific instruments such as the MS 112 of FIG. 1, installation processing, including instrument setup, testing and reporting, may be performed. Although such installation processing in connection with an MS will be described, it will be appreciated by those of ordinary skill in the art that techniques described herein may be used, more generally, in connection with other systems, instruments and devices.

Installation processing occurs, for example, at a customer site and is completed before the instrument may be used by the customer. Installation includes performing manual activities related to the physical setup of the MS where it will be utilized. For example, such manual activities may include unpacking instrument system components, connecting such components to a required power supply, to other instruments, and the like. Once this physical manual setup is completed, the instrument undergoes tests for installation and may include, for example, specification tests such as by injecting samples into the MS system (either directly or using a preceding instrument such as an LC) and examining MS responses, such as related to area, intensity, resolution, and the like, via analysis of generated mass spectral data. Such specification tests may be designed to ensure that the installed MS system meets certain performance criteria and other specifications such as those, for example, that may be published as part of marketing and other product literature.

Described herein are techniques that assist in automating the installation process for an MS instrument system. As noted above, the installation process includes mechanical installation operations, system set up, and performing installation testing. The installation testing may include, for example, changing and determining appropriate instrument settings, monitoring instrument readings, collecting system information, acquiring and processing mass spectrometer data to ensure that, after installation, the MS instrument meets or exceeds a set of criteria such as may be included in a published specification for the MS system. The techniques herein may include software that interfaces with the MS control system to perform the tests, set instrument values, observe and record instrument readings, and record and analyze MS performance data to determine whether established specifications or performance criteria are met. Rather than performing such installation tests manually, the techniques herein provide for automating the installation process including automating this installation testing process by automating control of the testing process steps, collecting test data and analyzing test data results regarding acceptability or not of testing conducted. Some testing and routines and analysis can be complex and, if done manually, may be error prone. Installation testing is performed to ensure that the MS instrument performs as established based on published specifications. In one aspect, installation tests may be for the MS system alone (e.g., instrument level tests that test functionality of the MS instrument system alone). For example, as described in more detail elsewhere herein, installation testing may include tests to examine MS generated data related to intensity, sensitivity, resolution and the like. In another aspect, installation tests may include system level tests which test the MS functionality in combination with other additional functionality not included in the MS, such as functionality regarding operation of the MS in combination with another instrument such as an LC instrument.

Described in following paragraphs are techniques that may be used to automate the installation process in connection with a MS. In one embodiment as described in more detail below, techniques may be embodied in a software tool or application that interfaces with the MS and its control system, for example, to automate performing the installation tests, set instrument values, observe and record instrument readings and system information, and acquire and process the system performance data. The use of such automated techniques provide for an orderly well-defined process for the installation process.

Tests and associated test data captured and analyzed during the installation process may be generally partitioned into two categories. A first category of tests and test data collected may be referred to as informational or information only. For example, an informational test may include registering the versions of control software used and registering versions of the firmware loaded on the instrument control electronics modules. Because of the nature of these tests (being information only), an embodiment may perform such information tests at any stage of the automated process. However, it should be noted that there is an advantage of simplicity from gathering all this information at the start of the automated process (e.g., after all manual procedures are complete).

A second category of tests and test data may be referred to as critical threshold tests and test data. With the critical threshold category, the test data collected may be used in connection with comparison to a performance threshold indicating a level of acceptable performance. More generally, critical threshold tests may be characterized as comparing observed data, such as from mass spectral data for the installed mass spectrometer, to predetermined performance criteria. For example, an observed metric obtained from collecting and/or analyzing test data may fall below a defined threshold indicating an acceptable performance level. In this case, the individual test that generated the test data may have an associated failure state and may otherwise have an associated pass or success state. With the critical threshold category, test data collected may be used in connection with comparison to performance threshold indicating a critical performance threshold. For example, an observed metric obtained from collecting and/or analyzing test data may fall below a defined critical threshold. Since the threshold is defined as a critical threshold and the test has failed, an additional remedial action outside the scope of (or in addition to) the general installation processing activity may be needed. Additionally, in connection with the failed critical threshold test, the entire installation testing process comprising multiple tests may be terminated until the one or more remedial actions are completed.

Installation testing may include performing tests included in a defined testing sequence of one or more individual tests, where test data may be collected from each such test. An individual test and its associated test data may fall into one of the foregoing categories. In connection with the automated processing of an embodiment in accordance with techniques herein, each of the required tests of the installation test sequence are performed in a defined order appropriate to the operation of the mass spectrometer. Where critical threshold data does not pass the required performance level, the testing is terminated to allow one or more remedial actions to be performed. Test results may be displayed to the user in a format appropriate to the data being presented.

As will be described below in more detail, in one embodiment described herein the user interacts with the software application to start the installation processing. The user may perform manual setup activities for the MS system. A software checklist of such manual operations may be enabled and displayed to a user enumerating the various steps to be performed. When all such mandatory manual setup activities have been confirmed by the user as having been performed, processing may be performed to automate setup of particular MS instrument settings. In connection with selecting and determining such settings, testing may be performed. Once such settings are determined, additional installation testing may be performed to determine whether the MS instrument meets specified installation criteria. A report of the test results may be generated. In connection with one aspect of the foregoing, the UI (user interface) may be viewed as controlling the overall process flow of the installation process by enabling the relevant functions in the software application at the appropriate time. The current state of the installation process may be saved and recalled by the software application so that, for example, a user may perform only some of the manual setup activities, only a portion of the installation tests, and the like, and continue with the remainder of the installation process at a later point in time. As another example, a user may perform installation testing having a failed critical threshold test. The software used in connection with an embodiment of the techniques herein guide and control the installation processing so that the installation testing may resume at a later point in time after an appropriate remedial action has been performed after the critical threshold test.

Each particular MS instrument system characterized by particular attributes may have its own customized set of tests as used in connection with installation testing. For example, the customized set of tests may vary with whether the instrument category is an MS or LC system. Furthermore, the customized set of tests comprising the test sequence, as well as particular thresholds, settings and other parameters used in connection with such tests, may vary with the particular attributes of each general instrument category or subcategories of MS instruments. For example, the tests may vary with whether the MS instrument is a quadrupole or time of flight (TOF) MS system. Furthermore, the tests may vary with the particular model and vendor of the quadrupole. For example, a first test sequence may be used with a first MS system such as the Xevo™ TQ Mass Spectrometer and a second different test sequence may be used with a second MS system such as the Xevo™ TQ-S Mass Spectrometer. It should be noted that the particular tests performed may vary with different attributes of the MS instrument under test such as, for example, whether the MS is TOF or includes one or more quadrupoles, the techniques used in connection with the ion source generating ions, and the like. The tests described herein may be used in connection with testing sequences for the Xevo™ TQ Mass Spectrometer by Waters Corporation which is a triple quadrupole MS system. Other aspects and components of this particular commercially available MS system will become apparent as particular tests are described in following paragraphs.

As described in more detail below in connection with a critical threshold test, if the critical threshold test fails, subsequent processing may include performing some corrective or remedial action. Testing may resume with the failed critical threshold test so that a failed test must now pass or succeed before the testing sequence is allowed to progress through to next test in the sequence. These critical threshold tests may utilize critical thresholds such as based on specifications or expected performance levels. Since testing does not progress from a current test to a second test until the current test completes successfully, tests in the testing sequence may be accordingly performed in a particular defined order based on dependencies between different tests and associated results. For example, in a test sequence, a first test for intensity or sensitivity may be performed as a critical threshold test. Subsequently, the test sequence may include performing a second test for resolution that is a critical threshold test. The tests may be performed in the order of first test and second test whereby the resolution test is not performed unless and until the intensity or sensitivity test has been successfully completed because failure to have sufficient intensity may invalidate results from the resolution test. In other words, there is no sense in proceeding to the resolution test if the intensity signal (as determined by the intensity test) does not meet minimum threshold values. More generally, a previous test may establish that certain minimum performance criteria are met before proceeding to a next test in the sequence whereby the next test is dependent on having such minimum performance criteria met, for example, to ensure validity of the next test, otherwise the next test is known to fail, and the like.

A set of tests may be characterized as peer tests whereby any test of the set may be performed in any order with respect to other tests of the peer set because there is no dependency of results or outcomes between such tests. A set of tests may alternatively be characterized as having dependent test results whereby a first test of the set may be required to have successfully completed prior to performing a second test of the set because execution or results obtained from the second test depends on having such successful completion or minimum criteria as established by successful execution of the first test. As noted above and elsewhere herein dependency among tests may be reflected in the order in which the tests in the sequence are performed so that, if possible, failure of a current test does not invalidate test results of previously successfully executed tests in the sequence. For example, failing a third test in the sequence may not invalidate results of the previous two tests which have been successful. If such a failure of the third test would invalidate another test, then the other test may be included in the testing sequence after the third test.

As described herein, repair work or another remedial action may be taken in response to a test failure. Therefore, depending on the particular remedial action performed in response to the failed test, it may be required to also reperform/re-execute one or more other previous tests in the sequence and once again pass/validate such previous tests after completing the remedial action thereby requiring that the testing sequence resume testing with a test in the sequence that was previously passed/successful. The automated testing techniques control such processing as may be required based on the particular remedial action. For example, a first test in the sequence may establish that the MS instrument is able to detect a minimum intensity threshold and a second test may be a resolution test to establish that the MS instrument meets minimum resolution criteria. The test sequence may perform the first test followed by the second test. If the second test fails, one of many possible remedial actions may be taken. For example, as a first possible action in response to the second test failure, a part of the MS instrument may be replaced. A part may be classified as "critical" or "non critical" where replacement of a critical part may result in resuming execution of the test sequence with a particular previously successful test. Replacement of a noncritical part may result in resuming with re-execution of the currently failed test without requiring re-execution of one or more previously successfully executed tests. In contrast, replacement of a critical part in response to the second test failure may require resuming testing with the first test rather than just retesting the second test in the sequence. As a second possible action, a particular chemical used in connection with the second resolution test may be the cause of the failure so this current chemical supply may be replace with, for example, a new or different chemical supply (e.g., same chemical having a later expiration date, different batch or lot of same chemical, or a different chemical). In this case, the remedial action includes replacing the current chemical supply with a new or different supply for the same or a different chemical and testing may resume with the second test without requiring retesting of any prior test that was successfully completed, such as the previous first test.

When re-testing is performed in response to a remedial action taken as described, the automated software techniques control the testing flow and resume testing with a particular test in the sequence where the particular test may depend on, and vary with, the remedial action. For example, consistent with the above-mentioned description, four tests in the sequence may have been successfully completed and a fifth test may fail. A first critical part may be replaced as a remedial action in response to failing the fifth test and may require that tests 3-5 be re-executed but not the first two tests. In this case, the testing sequence resumes with executing the third test. If a second different critical part is replaced as a remedial action in response to failing the fifth test, all 5 tests may be re-executed so that the testing sequence resumes with executing the first test. The foregoing control of the testing sequence is controlled automatically using the software in accordance with techniques herein.

A specification test may refer to a test in a testing sequence that demonstrates that performance criteria is met where such criteria is based on published performance specifications (e.g., marketing materials from a vendor regarding performance specifications for a particular MS instrument) as would be expected by the customer. Verification tests may categorically include specification tests and may also include other tests and processing for additional criteria not based on published performance specifications. Verification tests and specification tests may test just the MS instrument functionality and, in this case, may be also referred to as instrument-level tests. Verification and specification tests may also be characterized as system level tests which test the MS instrument functionality in combination with other functionality of other external components or instruments, or the MS integrated with/in combination with another component. For example, a system level test may test the MS performance in combination with a sample input or interface from an LC or GC. An example of a system level test may test the combination of the MS with a particular ionization source, using output from an LC instrument as input to the MS instrument, and the like.

What will now be described are UI displays or screenshots of an application performing installation processing in accordance with techniques herein. In connection with the example illustrated below, installation processing is described as may be used in connection with the Xevo™ TQ Mass Spectrometer.

Figure 2:
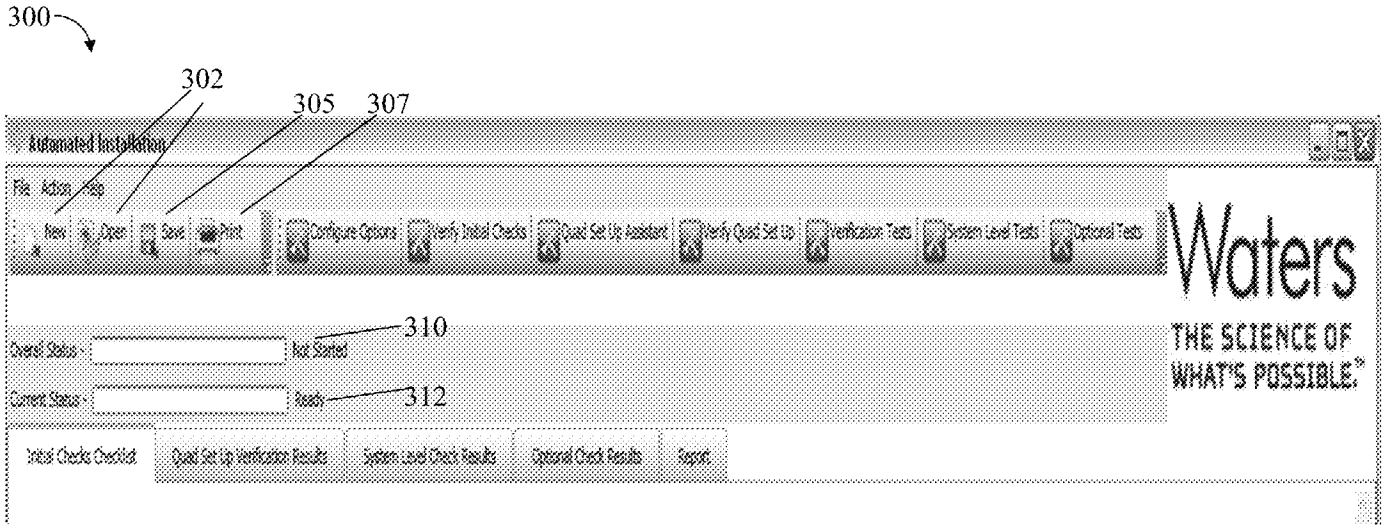

Referring to FIG. 2, shown is an example of a UI display of an application performing automated installation processing in accordance with techniques herein. The example 300 may be displayed on first launching the application prior to performing any installation processing steps. The example 300 may include various items of information related to a current state of the MS installation. For example, the example 300 includes an overall status 310 and a current status 312. The overall status 310 indicates that the installation process has not yet commenced. The current status 312 may indicate whether the installation testing software is ready.

Figure 3:
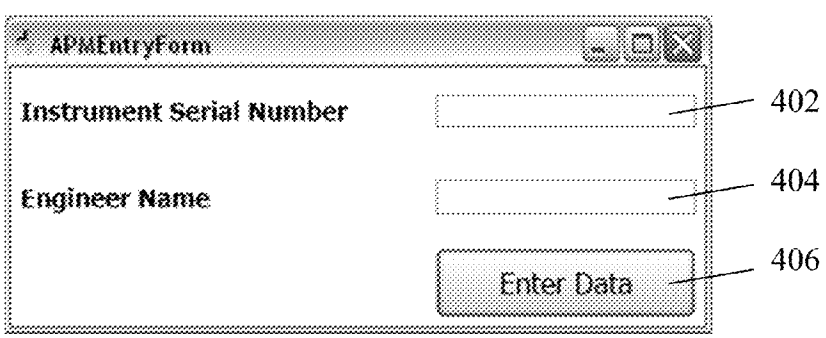
Figure 4:
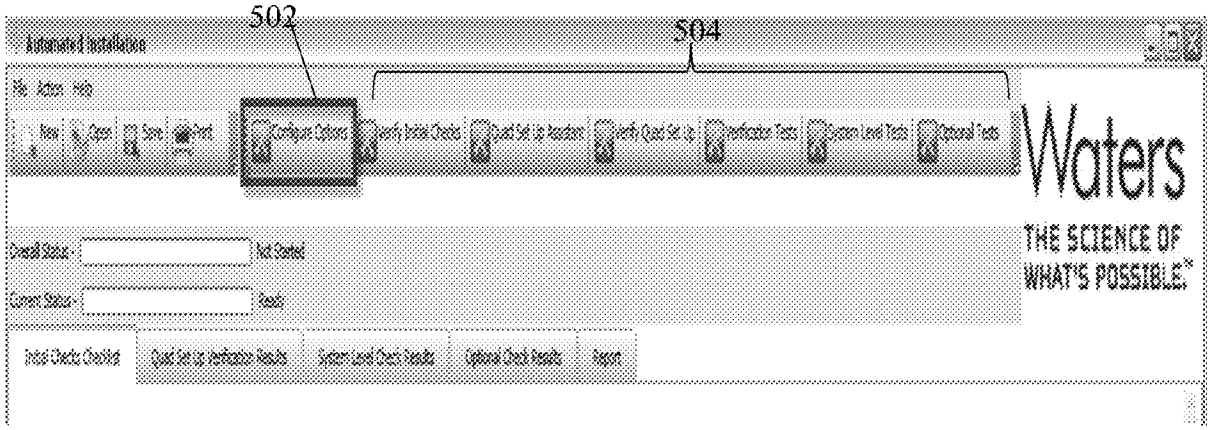

The user may then select new or open 302 and receive the dialogue box of FIG. 3. As illustrated in the example 400 of FIG. 3, the user may then enter an instrument serial number 402 and user name or identifier 404. The serial number entered into 402 may uniquely identify the particular MS instrument system thereby enabling tracking and identification of information such as related to installation processing and testing, remedial actions, and the like, for the particular MS system. The name or identifier entered into 404 may be a user identifier identifying a user of the software application controlling the automated installation processing. Data of 404 may be used as part of authentication of a valid user of the application or system performing the installation processing and testing. An embodiment may require other information than as illustrated in FIG. 3 prior to allowing the user to continue performing processing. Upon completion of data entry into 402 and 404, the user may select 406 causing the application to verify the entered data. If the data entered into 402 and 404 is valid, the application may then enable certain UI options thereby allowing the user to proceed to the next step or stage in the installation process. For example, FIG. 4 illustrates that the Configure option 502 may be enabled. It should be noted that other options or tabs such as 504 may be greyed out indicating that such option is not yet enabled. Portions of the installation processing associated with 504 are not enabled at this point in the installation processing so that a user cannot perform the processing associated with such steps. Thus, the UI provides a measure of control in connection with requiring and enforcing steps of the installation processing (including testing) to be performed in a particular predefined order.

It should be noted that if the user selects the open option of 302 rather than the new option of 302, the user may be prompted for information as illustrated in connection with FIG. 3. However, in response to entering the data of FIG. 3, an open file dialogue box may be displayed to open previously saved files of data in connection with previously performed installation processing sessions. For example, the list of files from which a user may select to open may include data for a previously completed installation process where only a portion of the installation processing has been completed. The list of files may include, for example, a file for a previously started but incomplete installation testing process such as where a critical threshold test failed. Using the open option, the user may now select to continue or resume the installation process and testing such as from the point in the testing sequence beginning with the failed critical threshold test.

With reference back to FIG. 2 and in connection with installation processing described above with selection of the open option of 302, when a file is selected, the program restores all the saved data, sets or restores the current installation testing state to be in accordance with the selected installation processing file (including information such as regarding testing state information), activates/deactivates the relevant menu and toolbar items, and the like, based on the current installation processing state being restored. The displayed menu bar may also include a save option 305 that may be activated/deactivated at appropriate times during the installation processing. Selecting a save option when enabled saves state information describing the current installation processing state (e.g., whether setup has completed, if a critical test has failed and where to resume testing, etc.) writes the current collected data (such as test result data) and installation state to a file with the serial number of the instrument (as entered by the user) and the current date formulated to a file name. Selecting the print option (e.g., see element 307) when enabled opens a print dialogue to choose a printer enabling a printout of the final report.

With reference back to FIG. 4, at this point, the user may select 502 to commence processing in connection with selecting configuration options. An MS instrument may have different optional components, parts, technologies, and the like where such instrument options may be characterized as purchased or customized instrument options. Selection of the configure option tab 502 may display a list of different MS instrument options from which the user may select different options applicable to the particular MS instrument being currently installed. In one embodiment, the user may manually select one or more such options whereby one or more option-specific tests may be performed as part of the installation testing process to test the particular instrument option. As a variation, an embodiment may provide for automated detection of all or a portion of such instrument options where possible rather than have a user manually select such options from a form or menu.

An example of an MS option may be varying MS inlet or MS ionization source options. Optional tests may test such functionality of the option when used with the MS instrument. As one example of an MS inlet option, sample input to an MS system may be from an LC or GC instrument, an ASAP (Atmospheric Solids Analysis Probe) probe, and the like. As known in the art, the ASAP (introduced by McEwan et al) is a useful tool for the rapid direct analysis of volatile and semi-volatile, solid and liquid samples using atmospheric pressure ionization. The ASAP technique utilizes the heated nitrogen desolvation gas to vaporize the sample and a corona discharge for sample ionization. This allows low polarity compounds not amenable to ESI (electrospray ionization), APCI (atmospheric-pressure chemical ionization) and APPI (atmospheric pressure photoionization) to be ionized with a high degree of sensitivity. Furthermore complex mixtures can be analyzed without the need for any sample preparation. This is described, for example, in U.S. patent application Ser. No. 13/105,605, filed May 11, 2011 Devices and Methods for Analyzing Surfaces, which is incorporated by reference herein. System level installation tests may include MS performance testing in connection with having a sample analyzed by the MS whereby the sample enters the MS using a particular MS inlet or MS ionization source in combination with the MS instrument.

As another example of an MS option, a particular type of MS instrument, such as a TOF (time of flight) MS may include an analyzer option referred to as ETD (electron transfer dissociation). As known in the art, ETD is a technique used to fragment ions in an MS. Similar to electron capture dissociation, ETD induces fragmentation of cations (e.g. peptides or proteins) by transferring electrons to them. Thus, ETD is one example of an option regarding components internal or within the MS instrument. As such, the MS instrument may include components used in connection with the functionality of the particular ETD option. Installation testing may include MS performance testing in connection with having a sample analyzed by the MS whereby components of the MS instrument performing the ETD technique are utilized. The foregoing are just a few examples of options that may exist in connection with using techniques herein.

Figure 5:
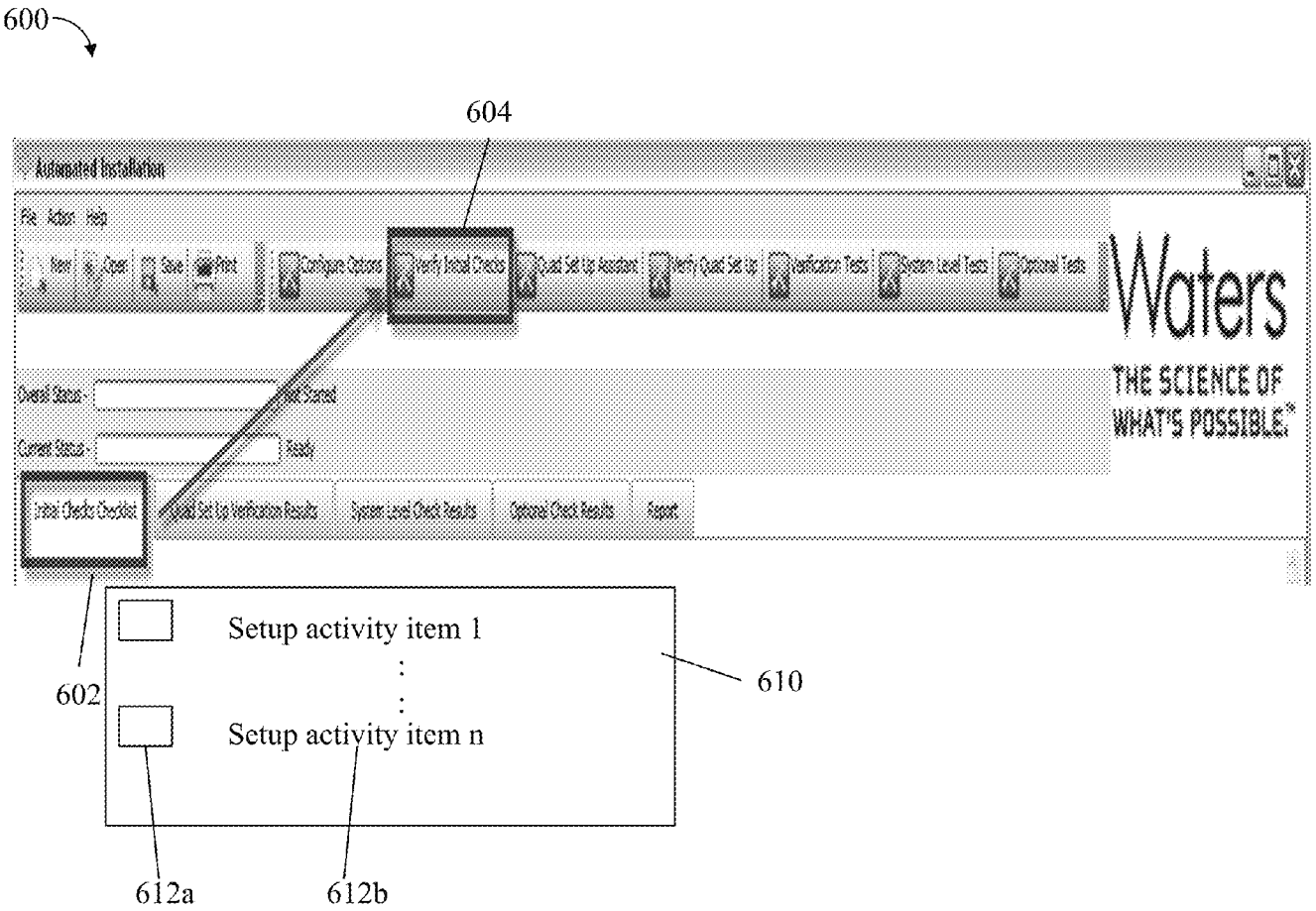

Referring to FIG. 5, the user may next perform manual set activities for the MS installation. The user may select 602 initial checks checklist. In response, a list 610 of such manual set up activities may be displayed. For each activity 612*a*, the list 610 may include a checkbox 612*b* so that when the user has completed the activity, the user manually selects 612*b* for the activity thereby indicating completion. Examples of manual set up activities for the MS are described elsewhere herein. Once all manual setup activities in the list 610 are completed and have been so indicated by selection of the checkboxes 612*b*, the user may select 604. In response to selection of 604 verify initial checks, processing is performed by the software to ensure that all checkboxes in the list 610 for the setup activities have been marked/confirmed as completed (e.g. such as denoted by having an "X" or checkmark in each box such as 612*a*). It should be noted that the manual setup may include physical set up of the MS instrument as well as other components or instruments external to the MS instrument to be tested and/or utilized in combination with the MS instrument. For example, the installation setup may include connecting the MS instrument to output of an LC inlet (e.g., output of an LC instrument providing sample input to the MS system) in connection with LC/MS analysis techniques known in the art.

After all checks are verified as completed by 604 processing, instrument specific set up procedures may be performed such as for the different and possibly varying instrument options selected in connection with the configuration options 502. For example, for a quadrupole-based MS system, such set up procedures for the MS options may include quadrupole setup processing where voltages applied to each quadrupole analyzer are optimized in order to optimize the transmission of selected ions through the analyzer.

Figure 6:
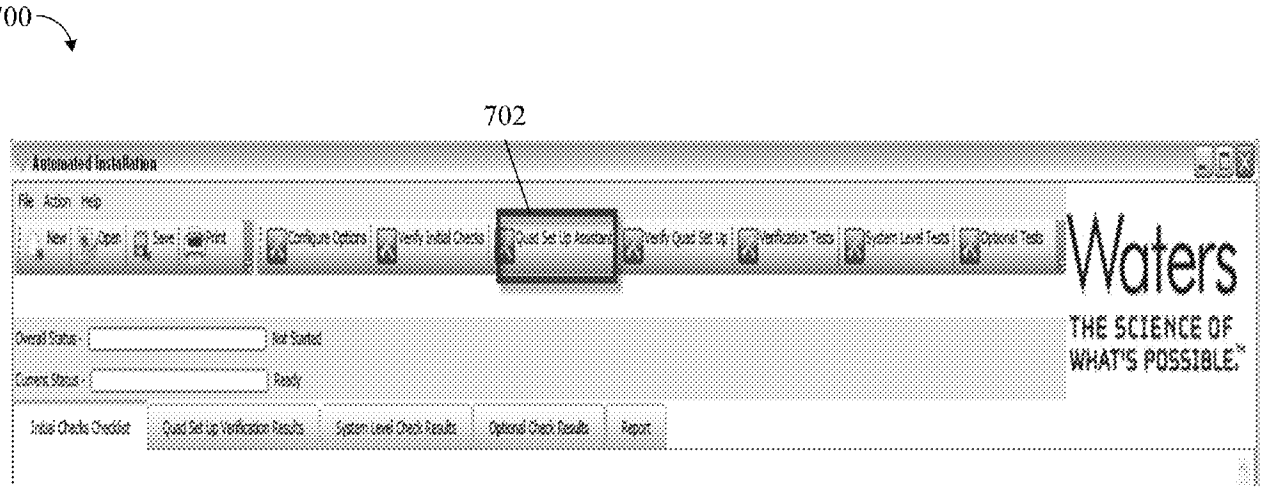

To perform the quadrupole setup processing as described, a user may select 702 of FIG. 6, for the quad setup assistant. The quad setup assistant may provide a level of automation in connection with selecting the RF and DC setting for each quadrupole. For example, if the MS instrument is a triple quadrupole, selecting 702 may assist in selecting appropriate RF and DC voltages for each such quadrupole. This may be performed in an automated manner using the software herein by iteratively varying the selected RF and DC voltages so that the resulting MS data for one or more ions has the expected mass position and expected mass spectral peak shape and/or width. After the MS instrument quadrupoles are set up such as by having the RF and DC voltages selected, the verify quad setup button or tab 802 of FIG. 7 may be selected to verify the set up processing performed in connection with 702 for each of the quadrupoles. The verify quad set up processing of 802 may then obtain and analyze mass spectral data for a longer time period and/or for additional ions (in comparison to any testing performed in connection with 702) to ensure the generated data includes correct mass positions, that the mass spectral peak's have a particular expected width to enable separation and discrimination between peaks, and the like. It should be noted that the verification testing performed in response to selecting 802 performs processing to test the operation of the quadrupoles based on the particular selected RF and DC voltages. When performing such tests in connection with 802, the sample and chemicals are introduced using the onboard or MS-local fluidic system. In other words, the testing performed in response to 802 selection is meant to isolate testing to the MS instrument alone without introducing, or by limiting, additional testing variable/factors such as having the sample introduced to the MS from an LC inlet.

Once the quadrupole setup has been verified by 802 processing, a user may select 902 verification tests to run a sequence of information gathering and test processes to confirm the MS is operating correctly. Tests performed in connection with 902 may test more varied aspects regarding performance and operation of the MS instrument. Tests performed in connection with 902 selection may include those tests generally referenced herein as instrument level tests which test the MS functionality. After each test in the processing in connection with 902, an assessment is made regarding the success of the test. If the test passes, the next test is performed until all tests are passed. If the test fails (since such tests may be critical threshold tests rather than just informational) the testing sequence may be paused until the user provides the detail of the remedial action taken. The software analyzes the remedial action and makes a decision regarding at what point to commence the test process. As described elsewhere herein, testing subsequent to performing a remedial action may commence from either the current failed test (e.g., if the remedial action is minor) or a previous test in the sequence (e.g., if the remedial action is major). As described above, a major remedial action may be, for example, replacing a critical component or part such as an ion optic component, one of the quadrupoles, the detector, or a major electronic assembly (e.g., such as the circuitry driving the RF voltage).

Figure 9A:
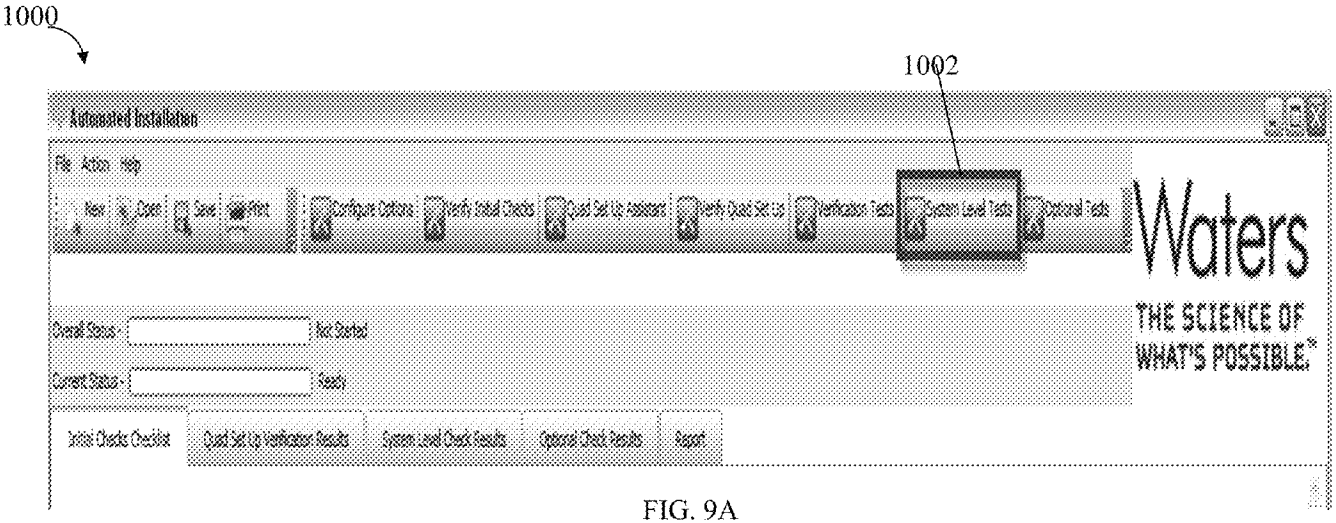

Referring to FIG. 9A, once the verification tests (or more generally the MS instrument level tests) are complete the system level tests can be performed by selecting the system level test button 1002. As described herein, system level tests may test functionality of the MS instrument in combination with other options or components external to the MS instrument. The process for the system level tests in connection with selecting 1002 is similar to that for the verification tests performed in connection with 902 with the difference that the decision on where to recommence testing subsequent to performing a remedial action may be at the verification instrument test level and/or the system test level. In other words, if a remedial action is performed in response to a failed system level test, testing may recommence with the failed system level test (e.g., by repeating the failed system level test), may recommence at a point in the test sequence with a system level test prior to the failed system level test (e.g., thereby now requiring successful re-execution of a previously successful system level test), or may recommence with performing a verification test included in the verification testing of 902 for instrument-level testing. In connection with the displayed user interface options, responsive to successful completion of the instrument level testing, user interface item 902 may be disabled and user interface item 1002 selected in connection with the system level testing may be enabled.

Figure 9B:
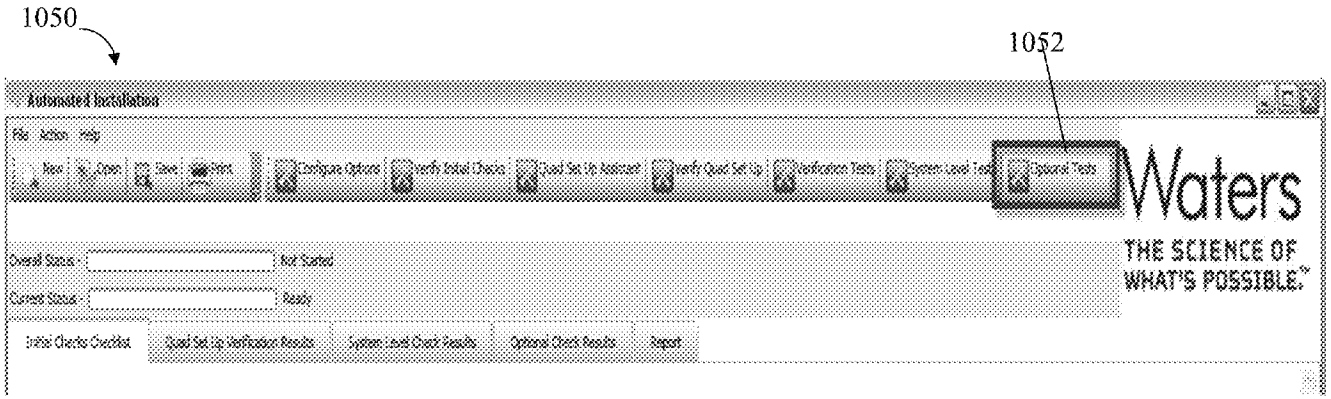

With reference to FIG. 9B, once the system level tests are complete, the optional component tests can be performed by selecting the optional tests button 1052. As described herein, testing performed in response to selecting 1052 may be tests for the particular customized options such as selected in connection with the configure options button 502 of FIG. 4. The process for the optional tests is the same as to that for the system level tests described above in that the decision regarding where to recommence testing upon completion of a remedial action may be at the verification test or instrument level, system test level, and/or the optional test level. In connection with the displayed user interface options, responsive to successful completion of the system level testing, user interface item 1002 may be disabled and user interface item 1052 selected in connection with the option level testing may be enabled.

Generally, as different portions of the installation processing are completed as represented by various user interface items (such as for configure options, verify initial checks, quad setup assistant, verify quad set up, verification tests, system level tests, optional tests of figures noted above), a next successive user interface item may be enabled and other user interface items disabled when associated processing of such disabled items is not allowed by the software controlling the installation processing.

Figure 10:
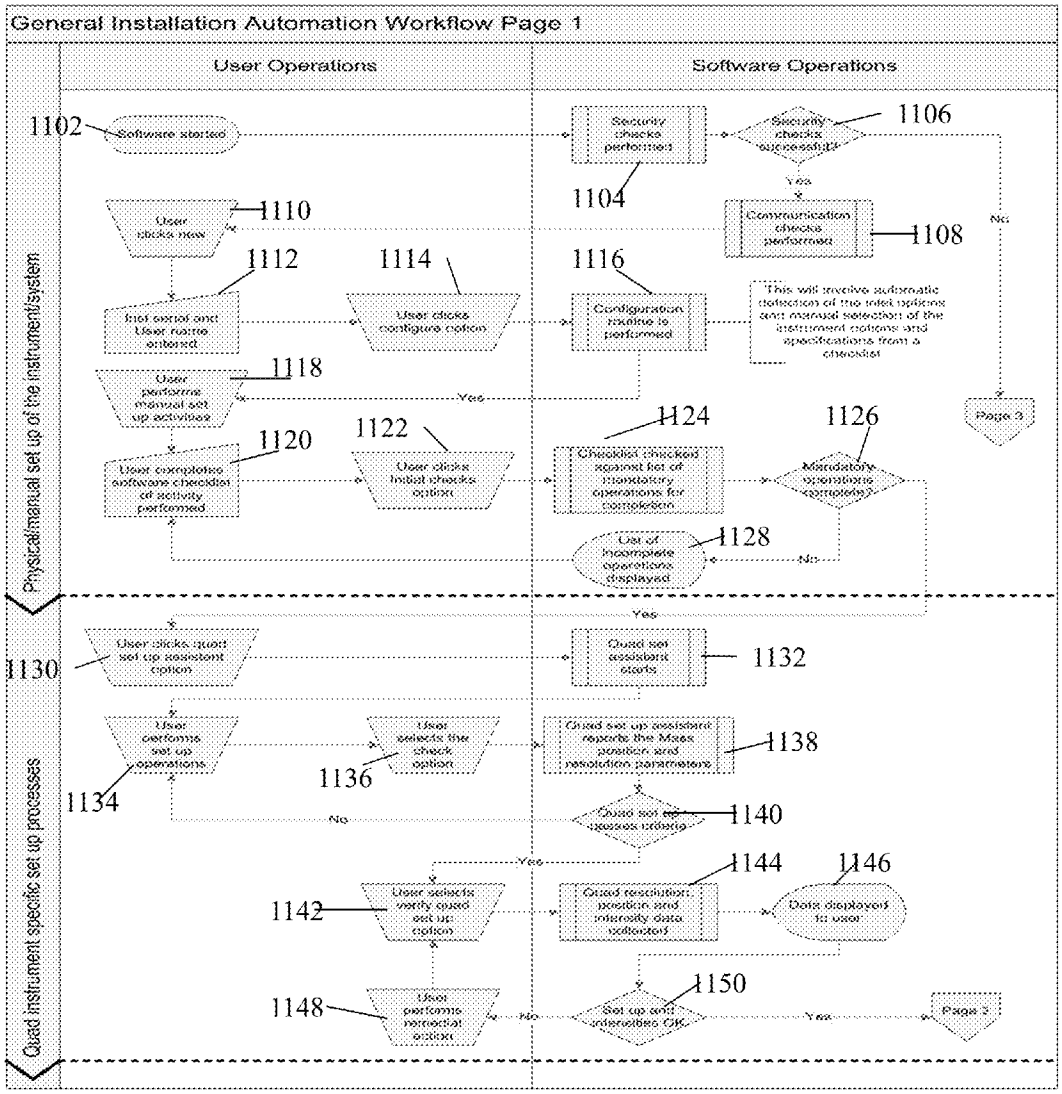
FIGS. 10, 11, 12 and 12B are flowcharts of processing steps that may be performed in an embodiment in accordance with techniques herein.

Referring to FIG. 10, shown is a flowchart of processing as may be performed in an embodiment in accordance with techniques herein for installation automation workflow. The flowchart 1100 generally summarizes processing as illustrated in connection with the preceding example with user operations and the underlying software operations performed in response to the user operations. The user operations on the left side of 1100 are those user actions such as user inputs via the UI. The software operations on the right side of 1100 are those performed in response to the associated user action on the left side. At step 1102, the application is started such as by launching the application on a computer system in communication with the MS system. In response, security checks may be performed in step 1104. Step 1104 includes performing a password generation algorithm based on a fixed keyword which provides a new password based on the keyword and calendar month. The security feature generates the password when the user first opens the software application. The program checks for a password file in the program folder. If the password in the password file does not match that generated by the program or the password file does not exist, then the user is prompted to enter a valid password. A valid password may include the user knowing a previously determined password used as part of the authentication process. If the user enters a valid password or the password in the file matches that generated by the program, the program continues to run, otherwise the program terminates. This security feature is designed such that once a user has entered a valid password, they can use the program without entering a password again until the end of a defined period of time, for example a calendar month, at which point a new password will need to be entered.

At step 1106, a determination is made as to whether the security checks at step 1104 are successful. If not, processing proceeds to step 1322 of FIG. 12 where the application terminates. Otherwise, processing proceeds to step 1108 where communication checks are performed. Step 1108 may include ensuring that the computer system upon which the application is executing has appropriate network connections, is able to pass initial communications tests.

In one embodiment, step 1108 may include performing processing as will now be described. During the communication testing of step 1108, the local domain name server may be checked for an entry identifying the embedded PC (which is the mass spectrometer control computer or EPC as discussed elsewhere herein) and the associated network address is displayed to the user for confirmation. If the user believes the registered EPC address to be incorrect, the user may be given the opportunity to enter a corrected address. Once the address for the embedded EPC is confirmed or corrected, the given address is "pinged" once. As known in the art, "pinging" refers to sending a network PING command to the address to test if the recipient received the command. The PING command may be used in determining if a recipient is connected to an existing network and able to communicate with the sender of the command. If a response is received, the address is then pinged and additional number of times (e.g., for example, such as 50 times at 1 second intervals) and the responses to the subsequent PING commands are evaluated. For example, the foregoing evaluation may be performed by counting the number of consecutive responses (each time a response is not received within 1 second the count of consecutive responses is reset to 0). If there is no response from the initial ping, the communication test is failed indicating no connection to the embedded PC. If the number of consecutive responses falls below 30, the communications test is also failed indicating an intermittent connection to the embedded PC. If the number of consecutive responses is 30 or above, the communication test is passed and the number of responses may be returned to the user along with the tested address. Other embodiments may perform variations to the foregoing in connection with performing any prescribed suitable communications test that tests communication of the mass spectrometer with the computer system, embedded or otherwise, used in issuing subsequent commands such as to control operation of the mass spectrometer. In connection with various tests as may be performed, the EPC may be used in connection with communicating with the MS system for control and operation of instrument settings, obtaining observed measurements such as temperature, and the like.

From step 1108, processing proceeds to step 1110 where the user selects the new option as described above in connection with FIG. 2. The user is then prompted in step 1112 to enter the instrument serial number and user name as described above in connection with FIG. 3. At step 1114, the user selects the configure option as described above in connection with FIG. 4 to initiate selection of the customized or variable MS options that may be included in a particular MS system undergoing installation. At step 1116, the configuration routine is performed where, as described above, step 1116 may include automatic detection and selection of some MS options and/or manual selection of instrument options from a checklist. Automatic detection of MS options may be performed, for example, for the different MS inlet options, different ionization source options, and the like (e.g., whether the sample is introduced via an LC inlet, whether an ASAP technique is utilized). At step 1118, the user performs manual set up activities to setup the MS instrument. At step 1120, the user completes the software checklist of manual activities and confirms that all such activities have been completed, such as by checking individual items from the checklist as described in connection with FIG. 5. At step 1122, the user selects the verify initial checks option such as described in connection with element 604 of FIG. 5. In response to selecting element 604, processing of step 1124 is performed where the checklist of items "checked off" as completed by the user via the UI is examined by the software to determine whether all required activities have been confirmed as completed. It may be that not all items in the activity list are required or mandatory. In step 1126, a determination is made as to whether the mandatory options are indicated/confirmed as having been completed. If step 1126 evaluates to no, control proceeds to step 1128 where the list of incomplete or unconfirmed mandatory options is displayed. From step 1128, processing continues with step 1120.

If step 1126 evaluates to yes, control proceeds to step 1130 where the user may select the quad setup assistant option as described in connection with 702 of FIG. 6. At step 1132, the quad setup assistant option processing is performed. At step 1134, the user performs setup options to setup the quadrupoles. Step 1134 processing may be automated and provide for automated selection of RF and DC voltages for each of the quadrupoles in the MS instrument.

At step 1136, the user selects may manually input or select RF and DC voltages. Rather than have a user manually input data in connection with step 1136, it should be noted that the processing loop including steps 1134, 1136, 1138 and 1140 may form the logic automated using processing herein in response to a single user action initiated by selection 1132. As described herein, such processing may be performed iteratively using software to tune and automate selecting optimal RF and DC voltages for the quadrupoles of the MS instrument. At step 1138, the quad setup assistant processing reports the mass position and mass resolution parameters. At step 1140, a determination is made as to whether the quad setup criteria has been met. If step 1140 evaluates to no, control proceeds to step 1134 to select new RF and DC voltages and repeat the processing with step 1136 and 1138 until step 1140 evaluates to yes. Thus, steps 1134, 1136, 1138 and 1140 may be embodied in software automating selection of the RF and DC values in accordance with techniques herein.

Step 1138 may be characterized as including performing multiple critical threshold tests related to peak width and resolution linearity (e.g., peak width) and peak position indicating a mass position in a generated mass spectrum. For example, the foregoing tests may result in acquiring spectral data and determining the width of a number of spectral peaks across a defined mass range. The data may be checked against peak width and resolution linearity thresholds. For example, in connection with one embodiment, the peak width threshold indicates that the observed peak widths be greater than 0.4 Da (Daltons—a measure of mass to charge ratio) and less than 0.6 Da at full width half maximum so that, in general, peaks that are separated by unit mass values are resolved to 50% of the peak height (unit mass resolution). Resolution linearity may be characterized as a measure of how much the peak widths vary across the mass range. In this example, for all measured peaks, the spread or variation between any two measured peak widths must be no more than 0.1 Da. During the resolution and mass position testing in one embodiment, mass spectral data is acquired and 5 peaks across the mass range 50-2050 Da are analyzed for their peak width and measured mass. The peak widths are measured against the thresholds for peak width and linearity and the peak positions are measured against the recognized reference value for the mass of the analyzed chemical. If the peak width or linearity is outside the defined range the resolution test fails. If the mass position of any peak is more than 0.5 Da from the recognized reference value, the mass scale or mass position test fails. It should be noted that these thresholds and methods for measurement are specific to this instrument type in the example and may vary for different MS instrument types. Also, in this example, the same set of acquired mass spectral data may be used for the resolution and mass position measurements for the step 1138 processing just described. Step 1138 processing may be performed for a limited time period or small data set in comparison to other processing performed in connection with step 1144 described below.

Figure 7:
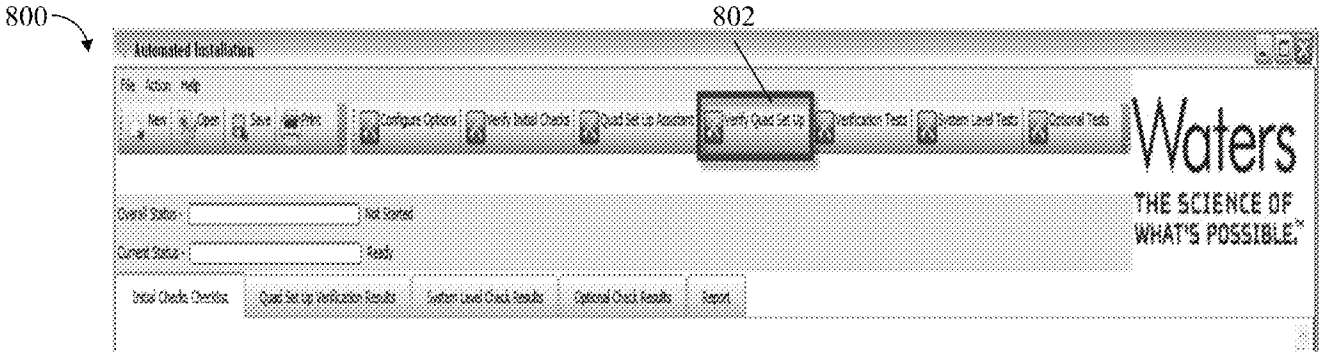

If step 1140 evaluates to yes, control proceeds to step 1142 where the user selects the verify quad setup option such as the verify quad setup option 802 as described in connection with FIG. 7. At step 1144, the mass position and mass resolution testing as described in connection with step 1138 may again be performed. However, in step 1144, the data obtained and analyzed may be for additional data sets such as, for example, a longer period of time and/or for more ions than in connection with step 1138. Additionally, step 1144 may include performing additional tests in the testing sequence than in step 1138. Step 1144 may also include performing a critical threshold test related to intensity. The critical threshold test as related to intensity may include, for example, acquiring spectral data and measuring intensity of a number of spectral peaks across a defined mass range. The measured intensities may be compared against one or more varying intensity thresholds depending upon the particular analysis performed for testing in an embodiment. For example, in this particular testing instance, 5 peaks, representing a chemical mixture, are analyzed with each such peak having a different expected response in the spectrum. Therefore, multiple thresholds are used as may vary with the particular peak and expected response so that each peak has a different intensity threshold. If the intensity of any peak falls below the threshold, the intensity test fails.

For detected peaks in connection with the resolution and peak position to be valid, the detected peaks need to be of sufficient intensity. For example, such insufficient intensity may result in particular ions not being detectable by the ion detector of the MS system under test. Furthermore, if detected peaks do not have a minimum intensity, such insufficiently low intensities may also similarly invalidate other subsequent test results The tests are placed in a specific order to ensure the validity of subsequent tests. In one embodiment, the tests of step 1144 may be performed in the following order of position, intensity and resolution due to dependencies therebetween. If the mass position results are not correct, it is not guaranteed that we have detected the correct peak, which invalidates the intensity data. Additionally, if the intensity thresholds are then passed (even though the mass position results are incorrect or not accurate within acceptable limits) then this invalidates any subsequent resolution measurement. However, it should also be noted that the position data may also be deemed inaccurate if the intensities are insufficient. Thus, there is a co-dependancy between position and intensity so that position and dependency tests are first performed (the order of which may be either position followed by intensity, or vice versa) followed subsequently by resolution. In the embodiment described herein, these measurements may be made from the same set of acquired data.

At step 1146, the data from the testing and results are displayed to the user. In step 1150, a determination is made as to whether the testing results from step 1144 have met established criteria. If not, step 1150 evaluates to no and control proceeds to step 1148 to perform a remedial or corrective action. From step 1148, control returns to step 1142.

Figure 11:
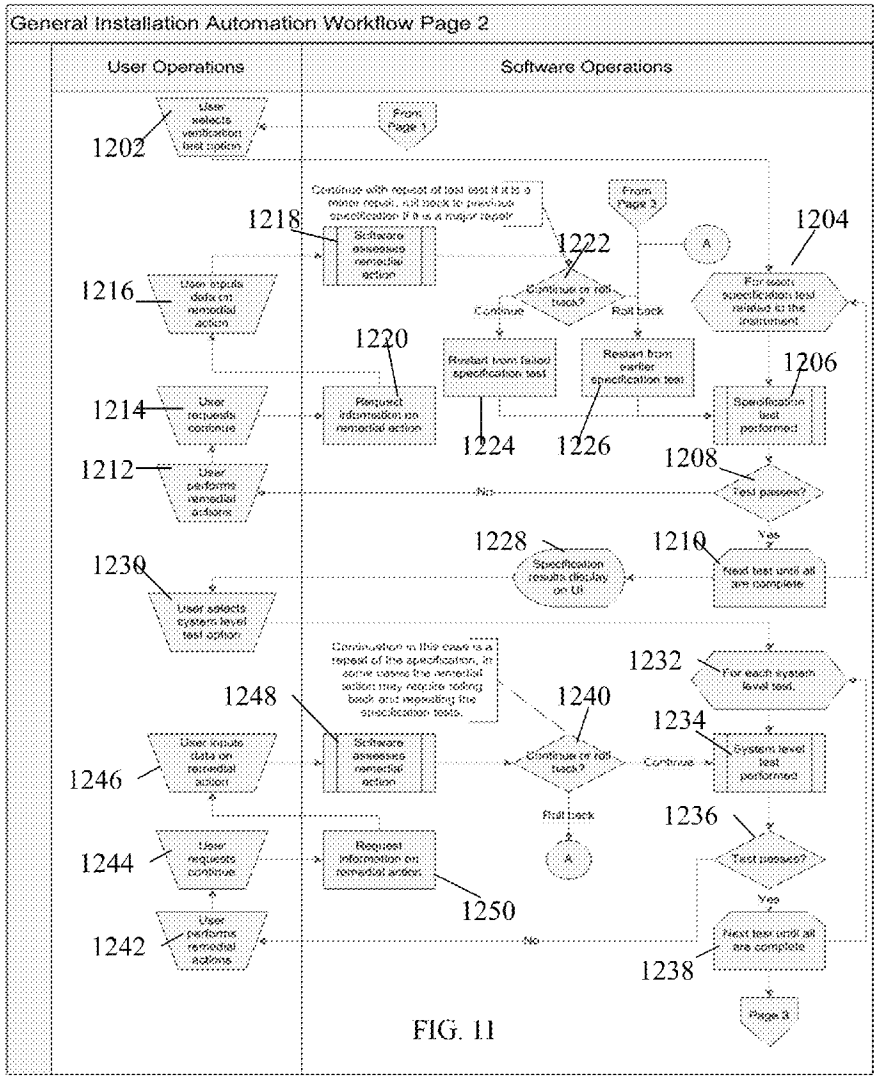

If step 1150 evaluates to yes, control proceeds to step 1202 of FIG. 11 where the user selects the test verification option. Step 1150 may include selecting verification tests button 902 as described in connection with FIG. 8. In this example, the test sequence may include instrument level verification tests which are specification tests having performance criteria in accordance with published MS performance criteria. At step 1204, for each specification test in the sequence, the test is performed in step 1206. At step 1208, a determination is made as to whether the test has passed. If step 1208 evaluates to yes, control proceeds to step 1210 with the next test in the sequence and control returns to step 1204 with the next test. Once all tests have completed successfully, control proceeds from step 1210 to 1228 where the specification test results are displayed on the UI. Recall that for other verification tests which are not specification based so that the performance criteria is not included in a published specification, such tests may be performed but results may not be displayed depending on the particular embodiment. For example, a vendor may not want to publish the criteria or standards for these additional tests. From step 1228, processing continues with step 1230 described below.

If step 1208 evaluates to no, control proceeds to step 1212 where the user performs one or more remedial actions. At step 1214, the user then selects to continue or resume testing. At step 1220, the software may request additional information regarding the particular one or more remedial actions performed in step 1212 in order to assess or determine where to resume testing. In step 1216, the user inputs the requested information regarding the remedial action. In step 1218, the software performs processing to assess the remedial action and determined where the resume testing. At step 1222, a decision is made regarding where (e.g., at what point in the testing sequence) to resume testing. For example, if the remedial action is characterized as a minor action such as a non-critical repair (e.g., replace a non-critical component or part), then control proceeds to step 1224 and then to step 1208 to restart from the failed test. If the remedial action is characterized as a major action such as a critical repair (e.g., replace a critical component or part), then control proceeds to step 1226 and then to step 1208 to restart from a test in the sequence prior to the failed test. Once the verification testing is completed thereby verifying that the MS instrument meets performance criteria, processing may be performed for system level testing.

At step 1230, the user selects the system level test option such as by selecting 1002 as described in connection with FIG. 9A. At step 1232 for each system level test, the system level test is performed in step 1234. At step 1236, a determination is made as to whether the system level test has passed. If step 1236 evaluates to yes, control proceeds to step 1238 and then step 1232 with the next system level test in the system level test sequence. Once all system level tests have completed successfully, control proceeds from step 1238 to step 1302 described in more detail below.

If step 1236 evaluates to no, control proceeds to step 1242 where the user performs one or more remedial or corrective actions. In step 1244, the user requests for testing to resume. In step 1250, the system requests information on the remedial action as in step 1220. In step 1246, the user inputs the requested information on the remedial action and the software assesses the remedial action in step 1248 (in a manner similar to that as described in step 1218). In step 1240, a determination is made regarding from what point testing is resumed in the sequence (e.g., resume testing with which system level test of the sequence). Step 1240 may determine that testing is to resume with the current failed test or another previous system level test in the sequence and control proceeds to step 1234. Alternatively, step 1240 may determine to resume testing by rolling back testing to the verification testing level thereby repeating some or all of the specification tests performed. In this case, control proceeds from step 1240 to step 1222 to resume testing from a point within the verification testing at the non-system level.

Figure 12:
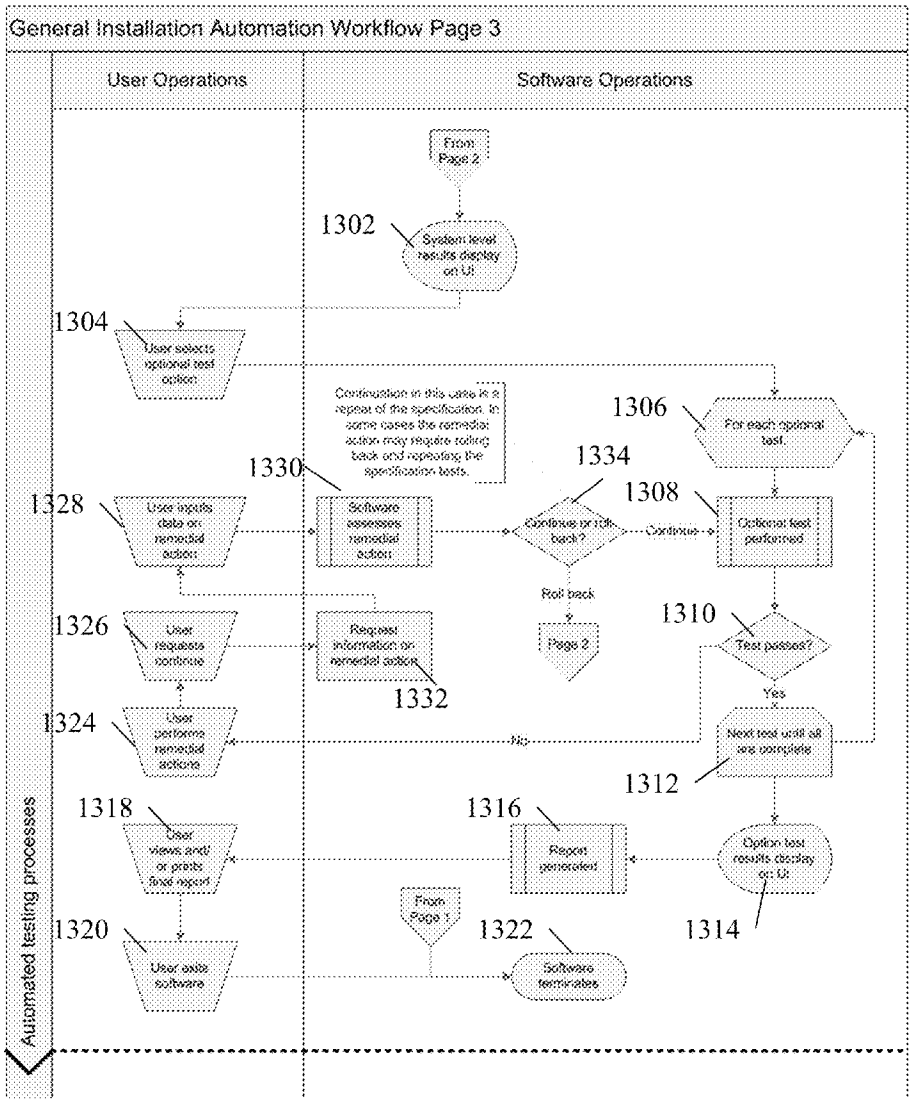

Referring to FIG. 12, at step 1302, the system level test results may be displayed on the UI once successfully completed. Control then proceeds to step 1304 where the user selects to perform testing for the MS options. Step 1304 may include the user selecting 1052 as described in connection with FIG. 9B. At step 1306, for each optional test, the test is performed in step 1308. A determination is made in step 1310 as to whether the test has passed. If so, control proceeds to step 1312 and then 1306 to execute the next test. Once all tests have completed, control proceeds from step 1312 to step 1314 where the option test results are displayed on the UI. From step 1314, processing proceeds to step 1316 described in following paragraphs.

If step 1310 evaluates to no, control proceeds to step 1324 where the user performs one or more remedial or corrective actions (in a manner similar to steps 1246 and 1212). In step 1326, the user requests to resume testing. In step 1332, the system requests additional information on the remedial action (as in steps 1220 and 1250). In step 1328, the user inputs the requested information (as in steps 1216 and 1246). In step 1330, the software assesses the remedial action (as in steps 1218 and 1248). In step 1334, a determination is made as to where to resume testing. Step 1334 may determine to resume testing with the current failed option test or another previous test in the option testing sequence and then continue with that test in step 1308. Step 1334 may determine to resume testing with a system level test or a specification test included as part of the verification processing. In this exemplary system, step 1334 may determine to resume testing with a specification test requiring rollback in the testing prior to the system level tests and option tests whereby processing now continues with step 1226 of FIG. 11.

As noted above, from step 1314, control proceeds to step 1316 to generate a report on the overall testing and installation processing. In step 1318, the user may print and/or view the final report. In step 1320, the user exits the software and in step 1322 the software terminates.

Figure 12B:
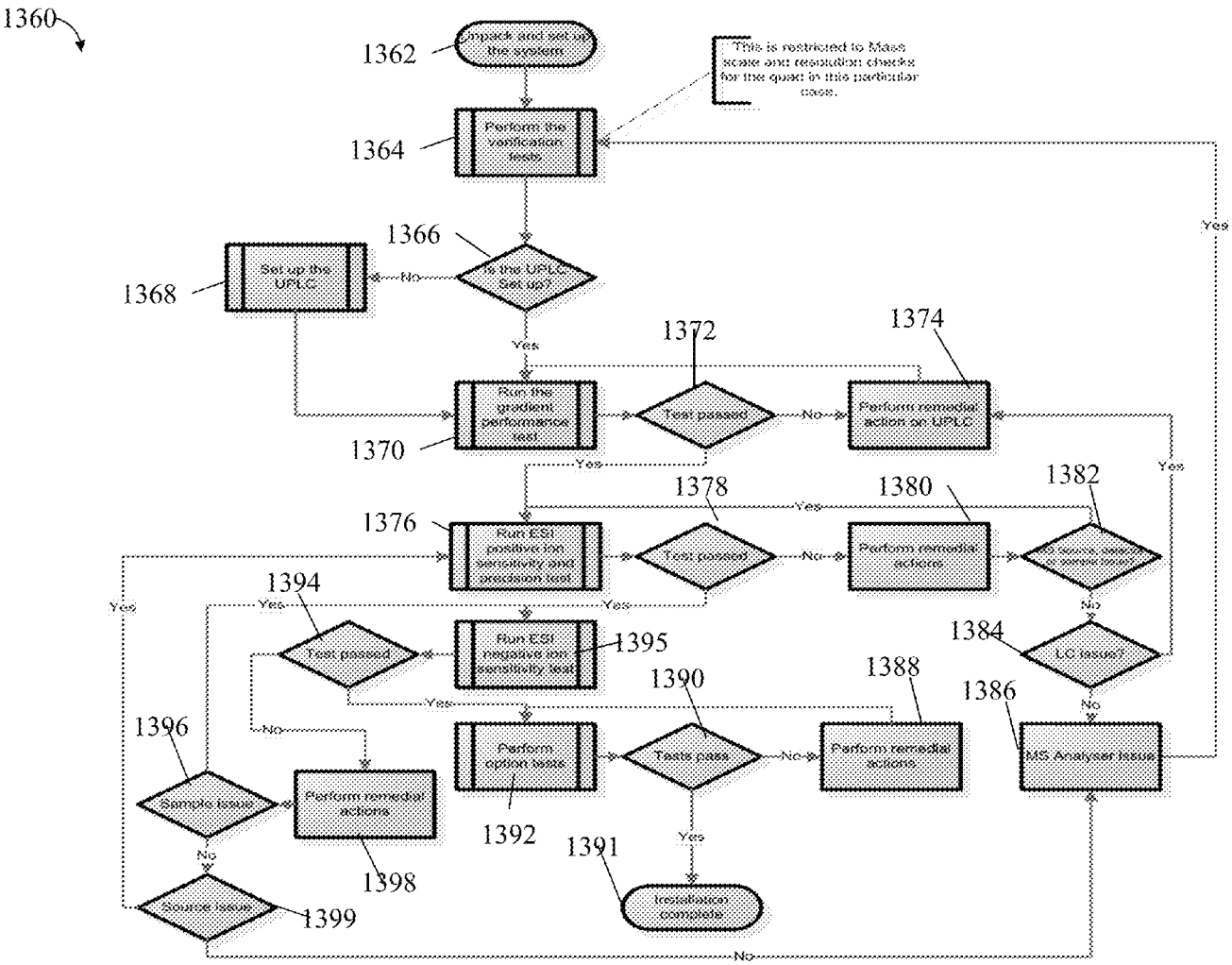

Referring to FIG. 12B, shown is a flowchart of more detailed processing as may be performed for the in connection with installation processing for an instrument system including MS and LC instruments where the LC instrument outputs a separated sample provided as input to the MS instrument. In this particular example, the MS instrument may be the Xevo™ TQD Mass Spectrometer (which is a triple quadrupole MS instrument) and the LC instrument may be the Acquity™ UPLC, both from Waters Corporation. The flowchart 1360 summarizes the overall installation process as described above for the particular MS-LC instrument system. At step 1362, the MS instrument is unpacked and physically setup. At step 1364, the verification tests for instrument-level testing are performed. Step 1364 may collectively represent the tests performed in connection with quad(rupole) set up (e.g., steps 1138 and 1144), and testing performed in response to selecting the verification test option in 1202 (e.g., for MS instrument tests performed in step 1206). After step 1364 is completed, all such instrument level verification tests have been performed successfully. At step 1366, a determination is made as to whether the LC instrument is set up. If not, control proceeds to step 1368 to set up the LC instrument and then to step 1370. If step 1366 evaluates to yes whereby the LC instrument is already set up, control proceeds directly to step 1370. It should be noted that the LC instrument set up may include performing, for example, physical mechanical setup of the LC instrument and connecting the output of the LC instrument to the MS instrument. Testing performed in processing steps of FIG. 12B from this point forward may be characterized as system level tests. At step 1370, the gradient performance test may be performed. The gradient performance level test may be characterized as a system level test testing integrated functionality of the LC and the MS instruments whereby the LC output is input to the MS instrument. The gradient performance test of step 1370 runs an experiment in which the mixture or amount of two solvents used for LC separation are varied. During a run, the amount of each solvent changes. For example, each solvent may be initially present in equal amounts (e.g., 50% of each solvent) at the start of run. During the experiment for which data is collected for testing, the mixture or amount of each solvent changes to a final ratio of 90% for one solvent and 10% for the other solvent. Compounds are expected to have particular retention times depending on the different concentrations of the two solvents. A number of repeated runs may be performed under what are assumed to be replicate conditions and all runs should produce a same set of peaks and curves. In other words, mass spectral data acquired for run 1 should be approximately the same as mass spectral data acquired for run 2 where the LC varies the solvent mixture, concentration or ratio in a similar manner in each run thereby providing replicate solvent mixture, concentration, or ratio conditions in each run. If there is variation in such MS acquired data, such as two retention time peaks in two runs are expected to have a same retention time and rather vary unacceptably between runs, then it may be determined that the LC which controls the solvent concentration is varying from run to run and should not. In other words, the unacceptable performance as illustrated by the MS data is due to the LC operation regarding varying the solvent concentrations. Rather than provide for replication of test conditions for different experimental runs, the LC operation may be causing unacceptable variations in the solvent concentrations between runs.

Figure 12C:
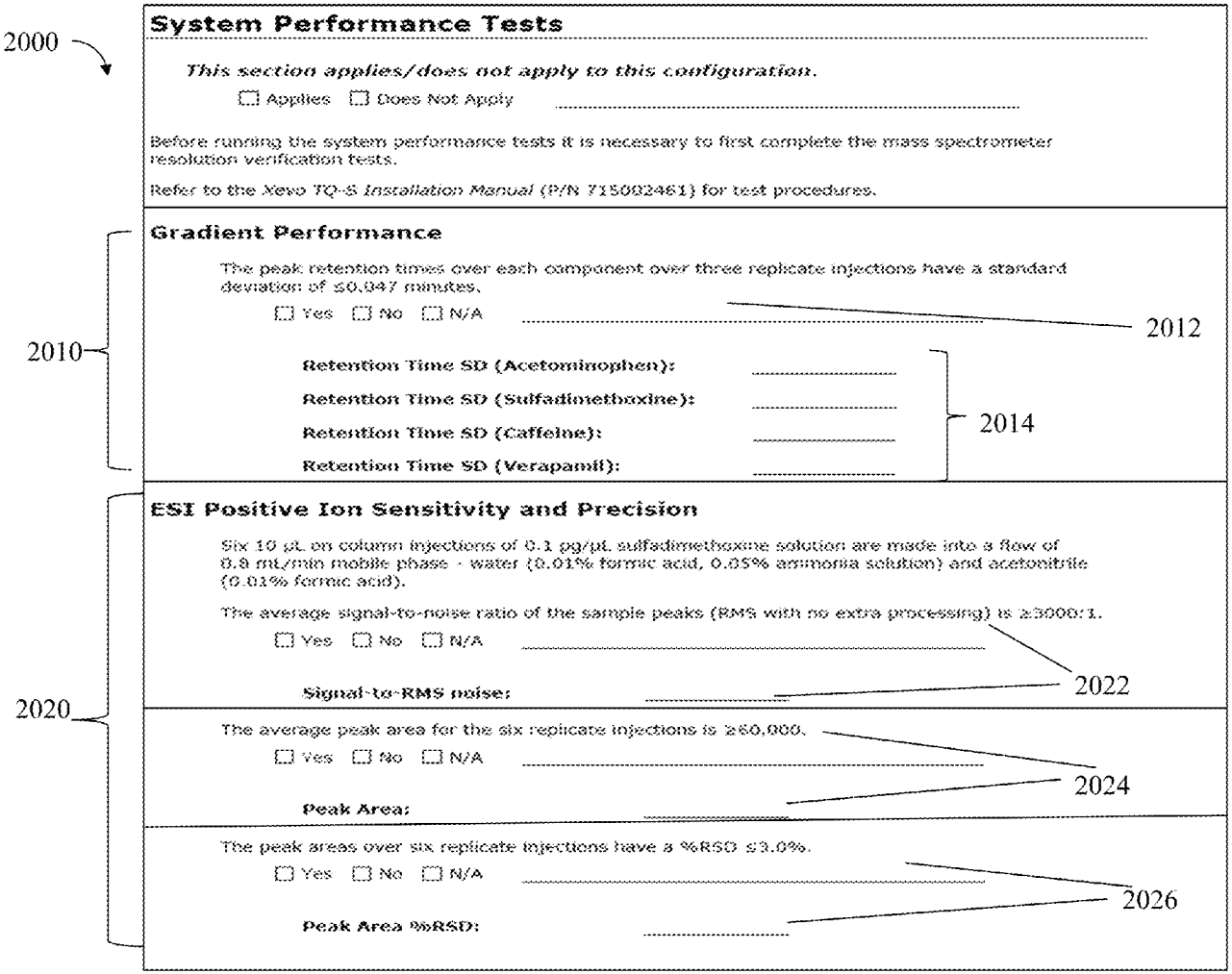

Referring to FIG. 12C, element 2010 provides an example of test results as may be displayed in connection with the above-mentioned gradient performance test of step 1370. In this example, three replicate injections may be performed. For each replicate injection, the MS spectral data of four compounds of 2014 may be observed. Each compound or component is expected to have the same MS spectral peak shape and retention time in each of the three runs within some acceptable threshold of variation/difference such as, for example, equal to or less than 0.047 minutes. If the observed data for any one or more of the four compounds varies in the three runs by more than this acceptable threshold variation, then the test fails. As noted above in this example, system level testing includes performing a gradient performance test whereby the liquid chromatography instrument varies concentrations of solvents during a first run and during a second run. More specifically, the test may include comparing first mass spectral data acquired from the first run to second mass spectral data acquired during the second run; determining whether any difference between the first mass spectral data and the second mass spectral data are within an acceptable threshold; and determining that the gradient performance test fails if any difference between the first and the second mass spectral data is not within the acceptable threshold, and otherwise determining that the gradient performance test passes. A first set of retention times of compounds in the first mass spectral data may be compared to a second set of corresponding retention times of the compounds in the second mass spectral data. If the gradient performance test fails, it is determined to take a remedial action on the liquid chromatography instrument and, subsequent to performing the remedial action, the system level testing resumes with reperforming the gradient performance test.

Referring back to FIG. 12B, at step 1372, a determination is made as to whether the gradient performance test of step 1370 has passed. If not, control proceeds to step 1374 where a remedial action is performed on the UPLC instrument. Examples of remedial actions may include, for example, checking the quality of the solvent, glassware cleanliness, expiration date of sample, sample preparation, and checking to ensure that the LC column is given sufficient time to equilibrate. Control proceeds to step 1370 to reperform the gradient test.

If step 1372 evaluates to yes, control proceeds to step 1376 to perform the next system level test. At step 1376, the ESI positive ion sensitivity and precision test may be performed. Step 1376 may perform processing to test the signal to noise ratio and sensitivity of the system. The MS instrument may use ESI (electrospray ionization) to generate ions as part of the ion source of the MS system. ESI is one technique known in the art to generate ions through an electrospray whereby droplets undergo evaporation and breakup into smaller droplets, which lead to the generation of ions that enter the MS system for analysis The use of the foregoing electrospray process to generate ions for mass spectral analysis by the MS device is known in the art as described, for example, in U.S. Pat. No. 4,531,056, Labowsky et al, Issued Jul. 23, 1985, METHOD AND APPARATUS FOR THE MASS SPECTROMETRIC ANALYSIS OF SOLUTIONS, which is incorporated by reference herein, and as also described in The Journal of Chemical Physics (1968), Vol. 49, No. 5, pp. 2240-2249, Dole et al., "Molecular Beams of Macroions", which is incorporated by reference herein. As known in the art, an ESI interface of the MS system (such as when interfacing with a preceding LC system), may include a spray source fitted with an electrospray probe. Mobile phase from the LC column or infusion pump enters through the probe and is pneumatically converted to an electrostatically charged aerosol spray. The solvent is evaporated from the spray by means of the desolvation heater. The resulting analyte and solvent ions are then drawn through the sample cone aperture into the ion block, from where they are then extracted into the MS analyzer. The ionization source of the MS instrument may be run in either a positive ion mode whereby positive ions are generated, or a negative ion mode whereby negative ions are generated. When in positive ion mode, only the protonated molecular ions are generated. In the negative ion mode, only deprotonated molecular ions are generated. The detected ion peaks are (M+z)/z and (M−z)/z in positive and negative ion mode, respectively, where M represents the molecular weight of the compound and z the charge (number of protons). As such, the ion source may generate positive or negative ions depending on the mode and voltage settings applied to the ion source. Element 2020 of FIG. 12C illustrates an exemplary display of test results for the above-mentioned test of step 1376 for positive ion mode. As illustrated by 2022, the average signal to noise ratio may be expected to be equal to or above a performance threshold, for example, a ratio of 3000:1 for the sample peaks. As illustrated by 2024, the average peak area (of the observed peaks) for a number of replicate injections (such as six) may be expected to be equal to or greater than a threshold (such as greater than or equal to 60,000). As illustrated by 2026, the peak areas observed over the replicate injections are expected to have a relative standard deviation (RSD) of less than or equal to a threshold (such as less than or equal to 3%). If any of the foregoing threshold criteria are not met, the test fails.

Referring back to FIG. 12B, at step 1378, a determination is made as to whether the test performed in step 1376 has passed. If step 1378 evaluates to no whereby the test of step 1376 has failed, control proceeds to step 1380 where one or more remedial actions are performed. On failure of the test at step 1378 some extra diagnosis will be performed. This may include performing automated and/or manual diagnosis. An embodiment may include an integrated system that will run automated diagnostic checks. The purpose of the extra diagnosis is to isolate the issue to a problem with the LC (e.g., which may be a solvent leak, degradation of a consumable item such as a column or solvent or maybe a problem with solvent contamination) or a problem with the MS or sample (e.g., MS problems being source or detector related). If the extra checks are performed manually the software may ask the user for input on what resolved the issue and the assessment in steps 1382, 1384 and 1386 are performed by the software. The difference with automated diagnosis would be that the fault may be automatically determined or isolated down to the MS/LC/Sample level (and perhaps source or detector or analyser). Information regarding the actual remedial action(s) performed by the use may still be entered by the user in order to define the amount of re-testing. Based on the user input regarding the remedial action in combination with the particular problem, the software may control resumption of testing and the installation process at an appropriate point.

In step 1382, the software performs an assessment as to whether the remedial action performed affects a component of only the MS instrument such as, for example, related to the ion source, detector or sample. If so, then step 1382 determines that testing can resume with step 1376 for the currently failed test without requiring previously successful tests to be reperformed. If step 1382 evaluates to no, control proceeds to step 1384 where a determination is made as to whether the remedial action performed relates to the LC system. If step 1384 evaluates to yes, then control proceeds to step 1374 and then to step 1370 to resume testing. If step 1384 evaluates to no, control proceeds to step 1386 where it is determined that the remedial action relates to the MS mass analyzer component. In this case, testing resumes with the instrument level tests in step 1364. An MS analyzer failure which causes the replacement of a part in the analyzer component of the instrument may impact the mass scale, resolution and intensity results so if there is a problem in the analyzer (e.g., perhaps with the application of fragmentation energy in the gas cell (Q2 in the Q1/Q2/Q3 layout described herein) resulting in replacement of the gas cell), this necessitates stepping back to the instrument level checks. An issue with the sample or source or detector would not impact the results obtained in the instrument level tests in this particular example. The foregoing is an illustration however. It will be appreciated by those skilled in the art that there are instances where source and detector issues of the MS instrument may require the instrument checks to be performed. However, this has a low probability and for illustrative purposes and for most cases, just a repeat of the system level checks would be sufficient. The converse is true of analyzer issues.

If step 1378 evaluates to yes, control proceeds to step 1395 to perform the same test from step 1376 with the difference that it is performed for the negative ion mode rather than the positive ion mode as described above. Additionally, the thresholds used in step 1395 may differ from those used in step 1376. For example, step 1395 may use a threshold average signal to noise ratio of 400:1 (rather than 3000:1 as noted above), may use a threshold for the average peak area for the six replicate injections of 1000 (rather than 60,000 as noted above), may use a threshold of 3.0% for RSD of the peak areas as described above, and may use a threshold of 0.047 minutes as the standard deviation of the peak retention times over the six replicate injections as described above. It should be noted that an embodiment may perform testing in connection with positive ion mode and negative ion mode in any relative order.

At step 1394, a determination is made as to whether the tests of step 1395 have passed. If step 1394 evaluates to no, control proceeds to step 1398 to perform one or more remedial actions. Steps 1396, 1399 and 1386 may be performed as described elsewhere herein using software to assess the remedial action. At step 1396, the software performs an assessment of the remedial action performed to determine whether the remedial action related to the sample. Appropriate remedial actions for 1399 may include, for example, adjusting the electrospray probe position, cleaning the probe or the sampling cone of the source or fixing a pressure/vacuum leak on the source. Remedial actions may also include adjusting the voltages applied to the source. For sample issues (e.g., step 1396), remedial actions may include, for example, making fresh samples to verify concentrations and compositions, or using fresh solvent if there is a contamination issue. LC issues are not mentioned at this point because by now the LC issues should have been discovered and corrected. It should be noted that the example illustrated herein may be characterized as a simplified illustration of progressive flow in which some expectations and simplifying conditions are assumed as described. Ideally, all issues/problems in connection with the LC system may be expected to have been identified and resolved by this point in the process. However, an embodiment may also alternatively consider the possibility of LC problems also being incurred at this point in processing as well. Any failure at the points 1372, 1378, 1390 or 1394 result in extra diagnosis (manually and/or automated as may vary with embodiment) and the remedial action may include a step for the user to feed back the remedial actions performed so that the automation software can roll back the testing process to the appropriate step.

If step 1396 evaluates to yes, control proceeds to step 1395 to resume testing with the currently failed test. If step 1396 evaluates to no, control proceeds to step 1399 to determine whether the remedial action was performed with respect to a problem with the ion source of the MS instrument. If step 1399 evaluates to yes, control proceeds to step 1376 to resume testing with the positive ion mode test. If step 1399 evaluates to no, control proceeds to step 1386.

If step 1394 evaluates to yes, control proceeds to step 1392 to perform any options tests. At step 1390, a determination is made as to whether the options tests have passed. It should be noted that step 1390 may include performing tests, for example, for other ionization sources that may be included in the particular MS instrument configuration such as related to APCI, APPI and the like. If step 1390 evaluates to no, control proceeds to step 1388 to perform one or more remedial actions and then resume testing in step 1392. If step 1390 evaluates to yes, control proceeds to step 1391 where it is determined that installation of the MS instrument is complete.

It should be noted that the particular points at which testing is resumed in connection with a failed test in FIG. 12B processing may vary from that as described above in a particular embodiment depending, for example, on the particular test, instrument, remedial action, and the like. In connection with FIG. 12B, there are several critical threshold points in the illustrated processing based around the system performance tests/checks such as at steps 1370, 1376 and 1395. Each of the test results builds upon the previous as an example illustrating test dependencies affecting the selected ordering. For example, there is an expectation that if the gradient test of step 1370 has passed, the LC is not expected to cause issues with the tests performed in steps 1376 and 1395. However, depending on the remedy or remedial action performed in response to a test failure, if there is replacement of any hardware or a particular component such as related to the analyzer, detector, ion source, and the like, the point at which the installation test process recommences varies as illustrated.

Figure 8:
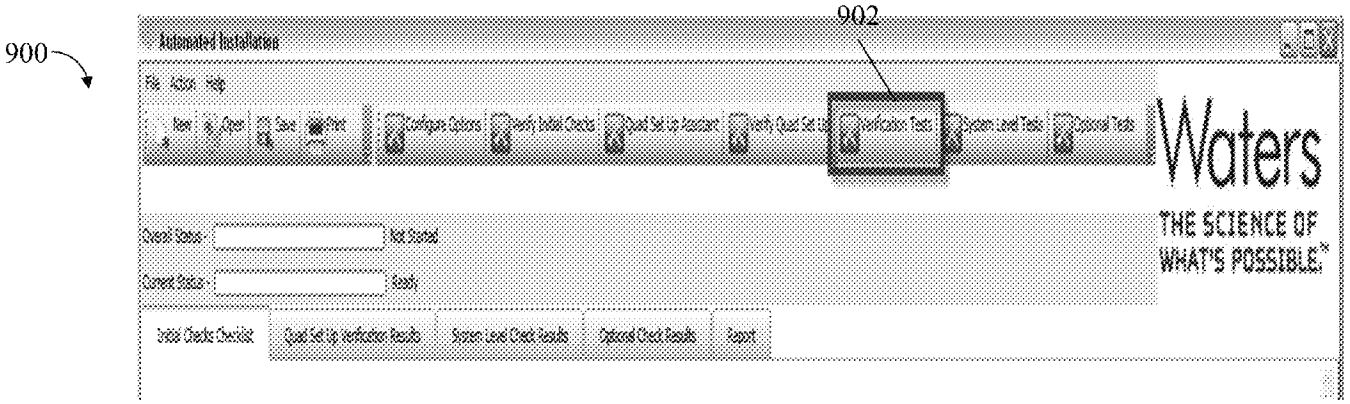

Referring to FIG. 12D, shown is an example of information that may be displayed in connection with performing a verification test in a testing sequence performed, for example, in connection with step 1364 and also in response to selecting button or tab 902 of FIG. 8. The example 2100 illustrates information displayed for a high mass resolution positive ion test of the MS data obtained from an MS instrument that is a triple quadrupole based MS instrument. For this test, the mass spectral data obtained for both the first and third quadrupoles is examined whereby each of the foregoing quadruoples operate as mass analyzers in a scan mode for a same set of ions. Thus, it is expected that the mass spectral data for the first quadrupole matches that of the third quadrupole, within some expected threshold tolerance or criteria (e.g., has same peak shapes at same retention times for the same set of ions). This test may be characterized as a verification test that is an instrument level test (e.g. MS only or non-system level test). In this test, MS1 in the example 2100 denotes the first quadrupole functioning as a mass analyzer and MS2 denotes the second quadrupole functioning as a mass analyzer. Mass spectral peaks are expected at approximately 2034.64 Daltons and 2035.63 Daltons and the valley between these two peaks when examining mass spectral data obtained from the first quadrupole as the first mass analyzer MS1 is expected to be less than 12% of the average height of the two peaks. Similarly, the valley between these two peaks when examining mass spectral data obtained from the third quadrupole as the second mass analyzer MS2 is expected to be less than 12% of the average height of the two peaks. FIG. 12D is an example of one test that may be included in such a testing verification sequence. As an example of remedial action that may be taken in response to particular failing test results for this test of FIG. 12D and where testing would resume, consider the case of a high mass valley test failure. Such failure may be caused by a vacuum problem, or a severe failure of the quadrupole or RF generator for the quadrupole. If both Q1 and Q3 (the first and second analytical quads) are exhibiting the problem then this may indicate a vacuum issue (leak). If only one of the Q1 and Q3 fail the foregoing test, this may indicate a problem particular to the failing quadrupole or generator that may indicate a need for replacement of a failing component (e.g., the failing quadrupole). In any case where a remedial action is performed for any of the foregoing, testing commences from the verification stage at step 1364.

It should be noted that the commercially available MassLynx™ Mass Spectrometry Software and its application manager from Waters Corporation may be used in an embodiment in connection with installation processing described herein. Waters MassLynx™ Software may provide functionality used in connection with instrument control and may be characterized as a platform including software to acquire, analyze, manage, and share mass spectrometry information as may be used in connection with the automated installation processing described herein, and in particular, in connection with the installation testing portion of such processing as described herein.

An embodiment in accordance with the techniques herein may be a software tool or application coded in C# using the Microsoft .NET Framework. The user interface may be coded using the Windows Presentation Foundation (WPF) and may include a menu system, toolbar and tabulated display pages for installation performance testing results, a manual activity checklist with optional comment text boxes, and a final report as described elsewhere herein. The instrument type (e.g., denoting an MS instrument system and the particular type of MS instrument system such as related to TOF vs. quadrupole, a particular MS system by a particular vendor, and the like) and test specific parameters used by such a software tool or application may be defined in a configuration file.

The software application in accordance with techniques herein may include a main executable for performing the performance maintenance automation process described herein supported by a hierarchy of functional libraries and interfaces. What will now be described is further detail about how the foregoing may be implemented in one particular embodiment. As will be appreciated by those skilled in the art, this additional detail is only one of many possible the techniques herein may be implemented in an embodiment. In following paragraphs, class libraries that may be used in an embodiment in accordance with techniques herein are described. Subsequently, additional figures and description provide further detail regarding use and interaction of the various classes in connection with a main execution thread such as in installation automation package providing functionality as described herein.

A base class library, referred to as the WEAT (Waters Engineer Automation Tool) base class library, may be defined that includes parameters and methods common to all supported mass spectrometers. The use of the term "WEAT" herein is merely descriptive for illustrative purposes of the example to refer to the particular library. The WEAT base class library may include the base classes and interfaces that are inherited for tests and utilities, log file construction, a web browser display window, embedded PC (e.g., the instrument control unit) control (e.g., command setting via scripted telnet commands and instrument readbacks through use of other libraries), data acquisition and processing such as in connection with MassLynx™ software by Waters Corporation, application security, communication testing and instrument fluidics control. In addition to a base class library, an embodiment may include one or more generic instrument libraries including test classes and utility classes specific to an instrument group such as particular group of MS instruments (e.g., quadrupole MS instruments, time of flight (TOF) MS instruments). Instrument specific libraries may also be defined which include test classes and utility classes specific to an instrument type or particular MS instrument system. For example, an embodiment may utilize a first instrument specific library with a particular MS instrument system such as the Xevo™ TQ-S or Xevo™ TQMS by Waters Corporation of Milford, Mass.

The WEAT base class library may include the 'WEATBaseClass' which is an abstract class inherited by each instrument group class (e.g., where class may be "quadupole" denoting a grouping of one or more types of MS instruments such as several types of quadrupole MS systems). The WEATBaseClass may provide for use of security features, log file features, internal web browser and page control features in the main executable application.

Additionally, an embodiment may also define the following classes in the WEAT base class library with the associated usage and descriptions as outlined in the TABLE 1 of FIGS. 19A and 19B.

In addition to the foregoing classes in Table 1, the WEAT base class library may also include an 'Utility' interface class and an 'ITest' interface class. The 'Utility' interface class is inherited by all automation utilities and the 'ITest' interface class. The 'Utility' interface class is a list of fields, properties and methods implemented for an automation utility. The 'ITest' interface class is inherited by all automation tests, extends the 'Utility' interface class, and may be defined in the WEAT base class library. The 'ITest' interface class is a list of fields, properties and methods implemented for an automation test. All automation tests inherit the 'ITest' interface class. The foregoing hierarchical structure is adopted because all automation tests perform those actions as performed by an automation utility as well as additional actions. However, the use of test and utility in a process flow or user interface is similar.

What will now be described in connection with Table 2 of FIG. 20 is an example of classes that may be included in an instrument-level derived class library for an instrument base class. In connection with an embodiment herein, an instrument base class may be created for each instrument group or instrument type as described above.

It should be noted that the ResolutionTest instance and the GainTest instance described in connection with Table 2 may be used in connection with functionality and features described elsewhere herein. For example, the ResolutionTest instance of Table 2 may be used in connection with implementing functionality and features of elements 1138, 1144 of FIG. 10, and element 1364 of FIG. 12B. The GainTest instance of Table 2 may be used in connection with implementing functionality and features of element 1144 of FIG. 10 and element 1364 of FIG. 12B.

What will now be described are figures providing further detail regarding use of the foregoing classes described in connection with Table 1 of FIGS. 19A-19B and Table 2 of FIG. 20 in connection with implementation of a software application, the installation automation package, in an embodiment in accordance with techniques herein.

Figure 13:
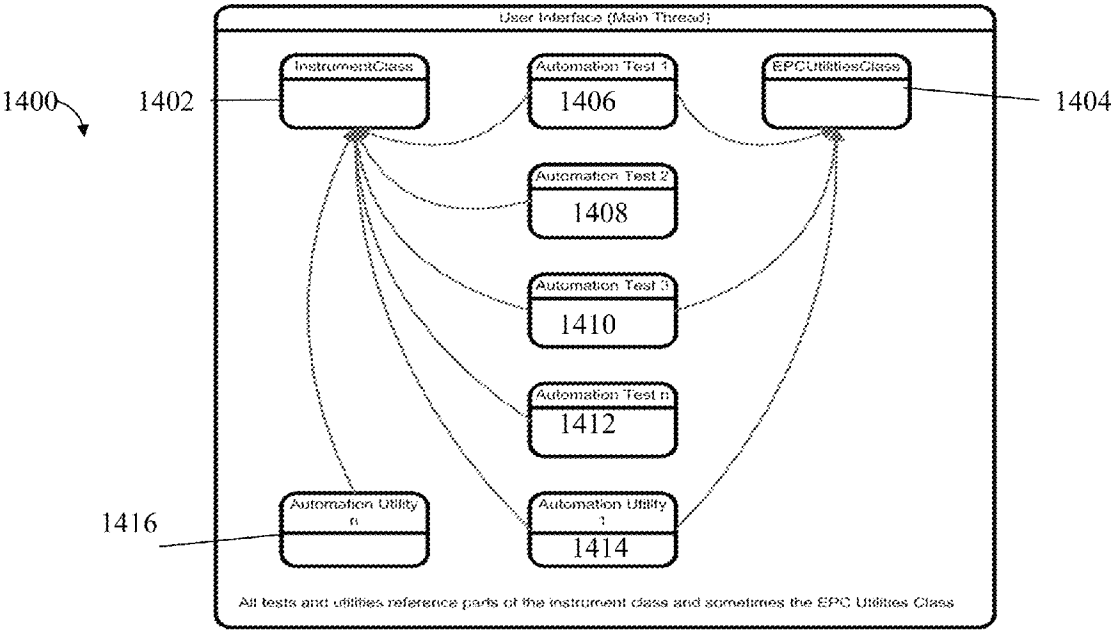
FIGS. 13-16 are examples illustrating use of classes in an embodiment in accordance with techniques herein.

Referring to FIG. 13, shown is an example illustrating a main execution thread utilizing classes in an embodiment in accordance with techniques herein. The example 1400 illustrates a main execution thread which is code of the user interface (UI). The main execution thread of 1400 may include an instrument class or instrument base class 1402, and EPC utilities class 1404 and one or more instances of Automation Test classes (1406, 1408, 1410, 1412) and/or Automation Utility classes (1414, 1416). Each of the Automation Test classes (1406, 1408, 1410, 1412) and/or Automation Utility classes (1414, 1416) may reference the instrument base class 1402 and the EPC utilities class 1404. The main execution thread of 1400 may include or utilize other code not specifically illustrated in FIG. 13. For example, the main execution thread may include code for event driven controls in connection with processing and handling UI events such as menu displays and selections (not illustrated).

The 'EPCUtilities' class 1404 is defined in the WEAT base class as noted above. A single instance of the 'EPCUtilities' class is created for use at the UI (user interface) class level and passed by reference to any test class that may need to use the methods of the 'EPCUtilities' class. The EPCUtilities' class includes control and monitoring functions for the mass spectrometer using the embedded processing computer (EPC) in the mass spectrometer. For example, the EPCUtilities class may include a connect method which allows two IP connections to the EPC, the first being a telnet scripting connection (allowing scripted commands to be sent to the EPC using the Telnet protocol) and the second connection to a server module running on the EPC. The first connection may be used to send commands to drive instrument settings. The server component provides access to instrument readbacks and statuses.

Figure 14:
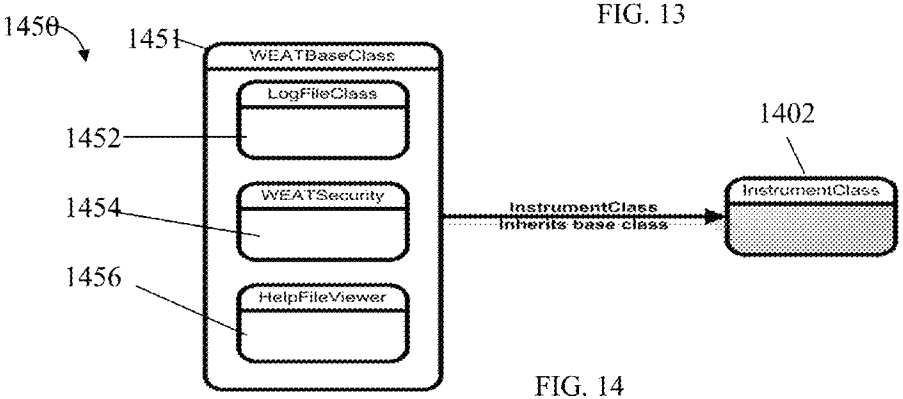

With reference to FIG. 14, the instrument base class 1402 is derived from the WEAT Base class 1451 as described above (e.g., in connection with Tables 1 and 2) which includes log file 1452, security 1454 and web browsing 1456 functions referenced by Automation Test class instances and Automation Utility class instances of the instrument class 1402.

Element 1452 may correspond to the LogFile class of Table 2 above. An instance of the log file class is created in the instrument level class library 1402 (which inherits the log file class from the WEATBaseClass) and this is passed by reference to individual tests to allow a log of test progress and results to be generated. The log file class 1452 may generate, for example, a formatted XML file containing results, comments and errors for all activity in the automated installation processing.

Element 1456 may correspond to the HelpFileViewer class of Table 2 above and including functionality for a form-based web browser. An instance of the browser class 1456 may be created in the instrument level class library 1402 (which inherits the browser class from the WEATBaseClass) and this is passed by reference to individual tests to allow the display of HTML or PDF help and diagnostic information. Functionality of the class 1456 may be used in connection with the UI, for example, to display help information.

Figure 15:
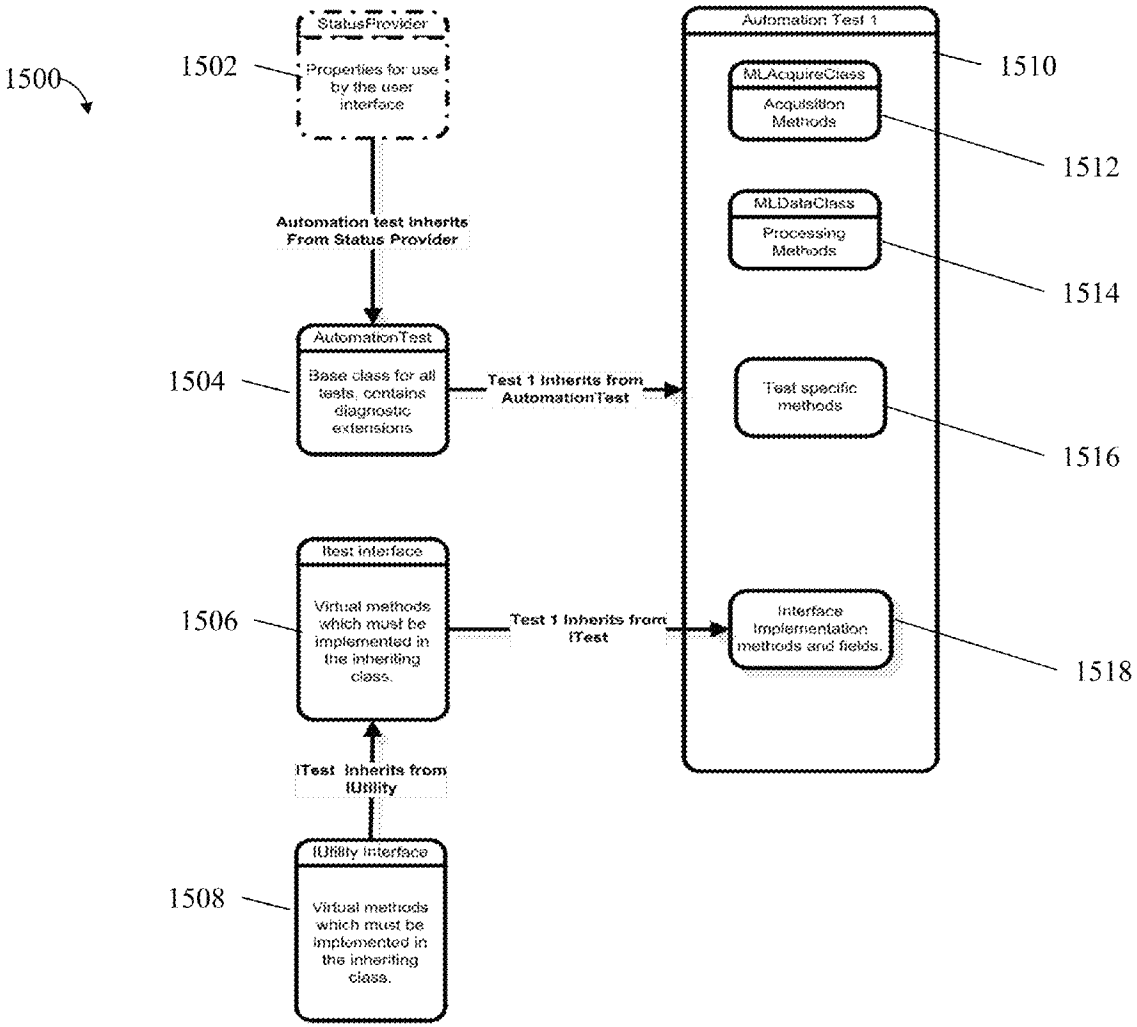

With reference to FIG. 15, shown is an example illustrating use of classes in connection with an Automation test instance, Automation test 1 1510, in an embodiment in accordance with techniques herein. Each individual test, such as 1510, is derived from the Automation Test Base Class 1504, which in turn inherits from the Status Provider Class 1502. The test 1510 may contain an instance of the MLAcquire Class 1512 and MLData Class 1514 along with methods, fields and properties (denoted 1516) specific to the test 1510. The test 1510 also implements methods 1518 of the inherited ITest interface 1506. The Itest Interface class 1506 and the IUtility Interface class 1508 describe interfaces of fields, properties and methods that are implemented as part of the test 1518. In other words, elements 1506, 1508 may define an interface for a method or data element which is implemented within the test 1510 and may be utilized by other code in connection with the user interface (e.g., to display test results, obtain test input data or selections, and the like). For example, methods having an interface as described by 1506, 1508 may be invoked in connection with implementation of the user interface for a particular automation test such as 1510. By each test implementing such defined interfaces as described by 1506, 1508, the user interface may perform uniform processing for all tests and such tests may be reusable with multiple application such as in connection with the installation automation application as well as others.

Figure 16:
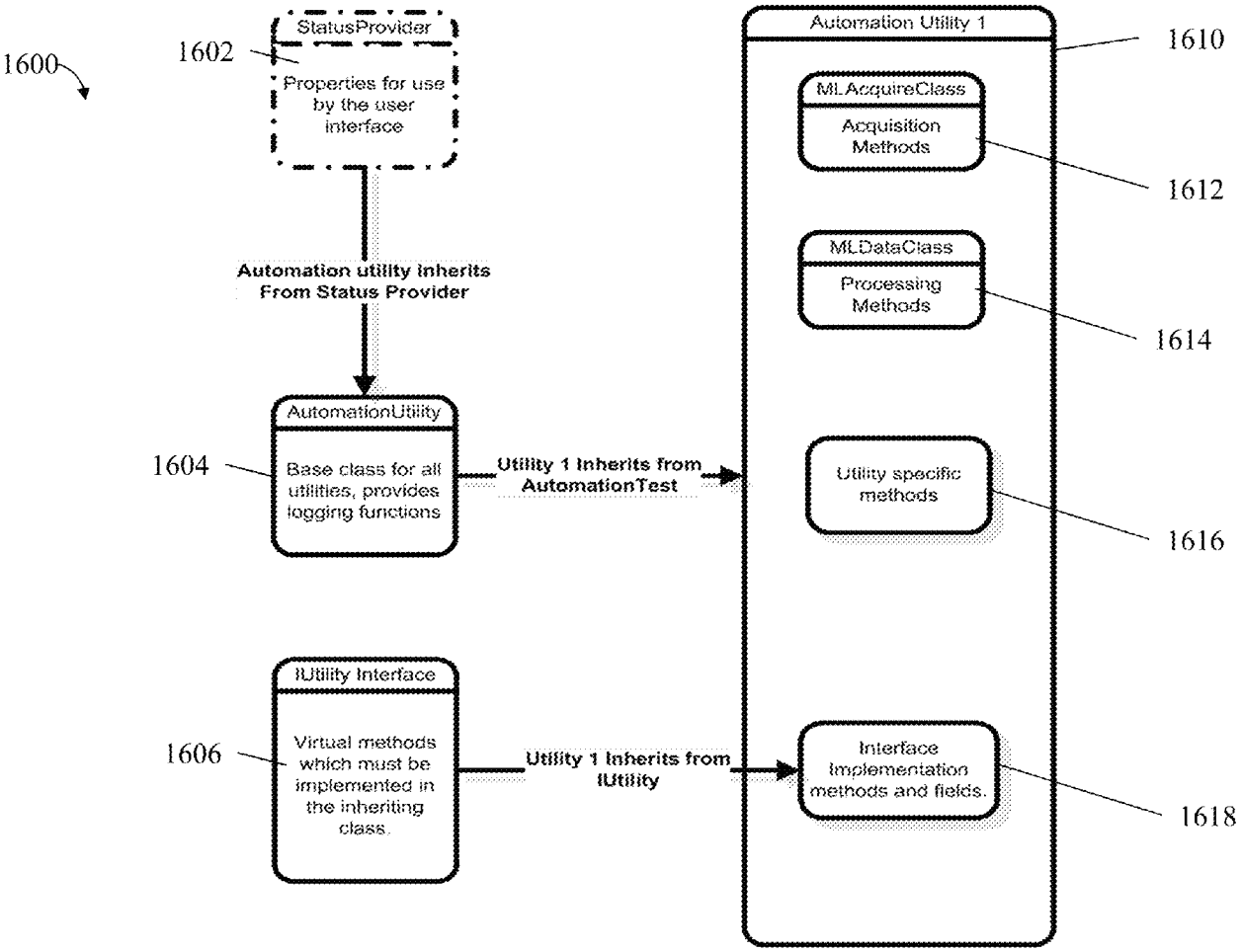

With reference to FIG. 16, shown is an example illustrating use of classes in connection with an Automation utility instance, Automation utility 1 1610, in an embodiment in accordance with techniques herein. Each individual utility, such as 1610, is derived from the Automation Utility Base Class 1604, which in turn inherits from the Status Provider Class 1602. The utility 1610 may contain an instance of the MLAcquire Class 1612 and MLData Class 1614 along with methods, fields and properties (denoted 1616) specific to the utility 1610. The utility 1610 also implements methods 1618 of the inherited IUtility interface 1606. The IUtility Interface class 1606 describes interfaces of fields, properties and methods that are implemented as part of the utility 1618. In other words, element 1606 may specify an interface for a method or data element which is implemented within the utility 1610 and may be utilized by other code in connection with the user interface. By each utility implementing such defined interfaces as described by 1606, the user interface may perform uniform processing for all utilities and such utilities may be reusable with multiple applications such as in connection with the installation automation application as well as others.

The 'StatusProvider' abstract class (denoted as 1502 of FIG. 15 and 1602 of FIG. 16) may be defined in the WEAT base class library as described above. The 'StatusProvider' abstract class may define a list of properties common to automation tests and utilities which define the state of a process at any time including display messages for the user, progress, error states and final outcome with access to results. The 'AutomationTest' class 1504 (class of automation tests) and 'AutomationUtility' class 1604 (class of automation utilities) inherit from the StatusProvider class. Any test or utility may have a final outcome of Pass, Fail or Warning, where Pass is successful completion of the test with a positive result, Fail is successful completion of the test with a negative outcome and warning is another alternative outcome. An automation test may be characterized as a test which returns a detailed result in addition to, or as an alternative to, one of the tri-state final outcome values of Pass, Fail and Warning, (for example a numerical value for a resolution measurement). An Automation test may also perform further diagnosis if a final outcome state is one other than Pass. An automation utility requires no such detailed results and does not require additional diagnosis as may be the case with an automation test. Based on the foregoing, the functionality of the AutomationTest class may be viewed as an expansion of functionality of the AutomationUtility class in accordance with the inheritance as illustrated in connection with FIG. 15. Each automation test, such as 1510, inherits from the AutomationTest class and each automation utility, such as 1610, inherits from the AutomationUtility class.

Figure 17:
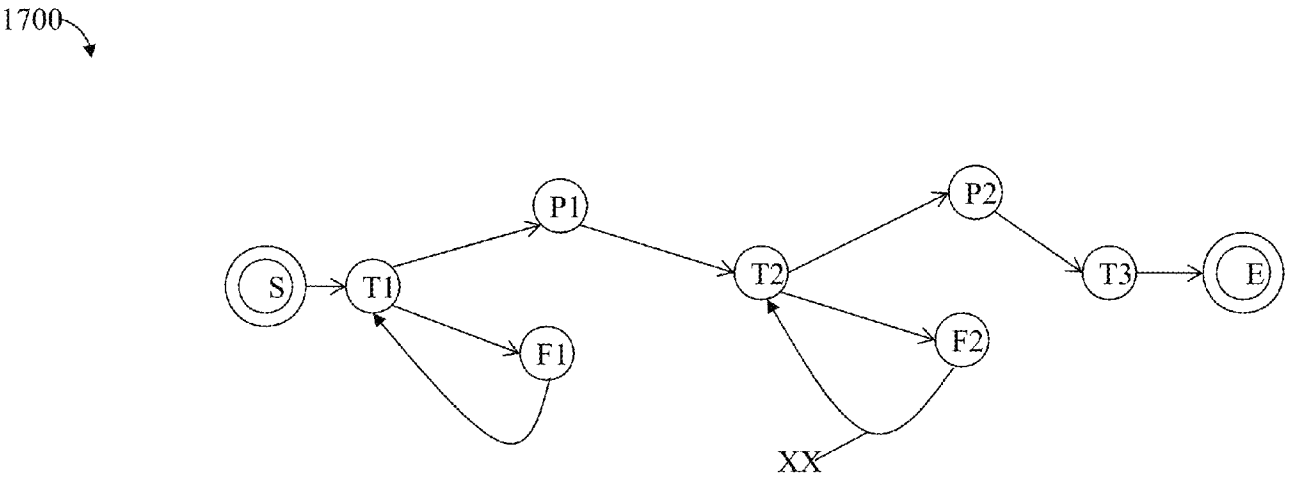
FIGS. 17-19 are illustrations of state transition diagrams used to represent exemplary test sequences and associated states for pre and post-maintenance testing in an embodiment in accordance with techniques herein.

Referring to FIG. 17, shown is an example illustrating a state transition diagram as may be associated with performing a testing sequence in an embodiment in accordance with techniques herein. The example 1700 provides a more general illustration of a simple testing sequence of three performance tests, T1, T2 and T3 included in a testing sequence such as performed in connection with verification testing for the MS instrument where each test may be a specification test. Generally, performance tests of a testing sequence may be implemented using any of the automation tests and/or automation utilities as just described. If the performance test has a resulting state that is one of pass, fail, or warning, or is for information only, then such a performance test may be implemented using only automation utilities of the above-noted classes. In contrast, a performance test requiring additional diagnostics, and/or returning a result other than one of the foregoing tri-state values of pass, fail, or warning may be implemented using automation tests alone, or in combination with, automation utilities. Thus, the term "performance test" or test of a testing sequence (as used with any of the verification tests, system level tests and/or option tests) should be understood as a procedure that may be implemented using automation test instances and/or automation utility class instances depending on the particular performance test. Each of T1, T2 and T3 denotes such a performance test.

The example 1700 is a state transition diagram including a directed graph used to describe the testing sequence, states and transitions between such states. The graph of 1700 includes a series of nodes (denoted by circular elements) representing states and directed edges between the nodes representing state transitions. The node S represents the testing sequence start state and the node E represents a successful testing sequence end state. Nodes T1, T2, and T3 correspond to states of performing the different performance tests. Nodes F1 and F2 may represent failure test result states such as in connection with critical threshold test failures as described elsewhere herein. Nodes P1 and P2 represent all non-failure test result states (e.g., tests having outcomes of "pass", "warning"), respectively, for critical threshold tests T1 and T2. Test T3 may be for informational use only and therefore always transition successfully to state E. Tests T1 and T2 may be critical threshold tests such that, upon failure, the testing sequence may resume or restart with the failing test and additionally require successfully performing all tests subsequent to the failing test in the sequence. This is consistent with the description above for critical threshold test failures as may occur in an embodiment in connection with installation testing. It should be noted that implicit with each failed state F1, F2 for a critical threshold test is performing a corrective remedial action and then transitioning to one of the testing states T1, T2 to retest. FIG. 17 is an example of a test sequence as may be performed in connection with verification processing for MS instrument level testing (e.g., such as in response to selecting 902 of FIG. 8).

As described herein, the foregoing of FIG. 17 may illustrate some of the transitions in a testing sequence which is a system level test sequence or an option test sequence. More specifically as described elsewhere herein, after a failed system level test, testing may also resume with an instrument level test as well as a test in the system level testing sequence. In a similar manner, after a failed option level test, testing may also resume with an instrument level test, a system level test, or an option level test. The foregoing is generally illustrated in FIG. 18.

Figure 18:
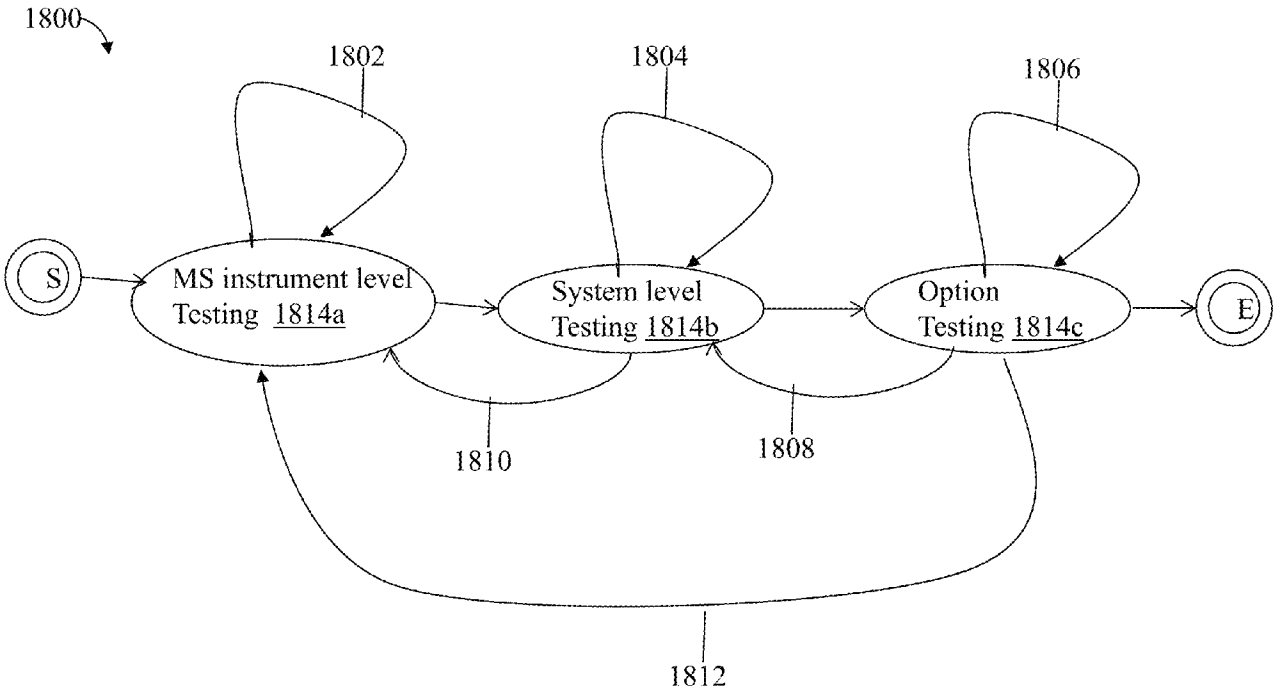

Referring to FIG. 18, shown is an example 1800 of a state transition diagram as may be associated with performing testing sequences in an embodiment in accordance with techniques herein. The example 1800 includes conventions generally as described above in connection with FIG. 17. It should be noted that the occurrence of testing failures and successes are not explicitly represented as states in this example but are rather implicit along with any remedial action(s) performed upon such testing failures in connection with the particular state transitions.

The example 1800 includes a start state S, ending state E, and additional transitions 1814*a-c* which each represent a testing sequence of one or more tests. Element 1814*a* represents the MS instrument level testing state such as described in connection with 1364 of FIG. 12B. Element 1814*b* represents the system level testing state of the MS instrument in combination with other components. Element 1814*c* represents the option testing state. The MS instrument level testing sequence represented by 1814*a* is performed first. Transition 1802 generally represents that upon the occurrence of a failed test in the instrument level testing of 1814*a*, testing may resume with a test in the instrument level testing 1814*a*. When instrument level testing of 1814*a* is successfully completed, the installation processing transitions to the system level testing 1814*b*.

Transition 1804 generally represents that upon the occurrence of a failed test in the system level testing of 1814*b*, testing may resume with a test in the system level testing 1814*b*. Transition 1810 represents that upon the occurrence of a failed test in the system level testing 1814*b*, testing may also resume with a test in the instrument level testing 1814*a*. As described herein, whether transition 1804 or 1810 occurs subsequent to a system level test failure may vary with the particular test failed and the remedial action(s) performed, if any. When system level testing of 1814*b* is successfully completed, the installation processing transitions to the option level testing 1814*c*.

Transition 1806 generally represents that upon the occurrence of a failed test in the option level testing of 1814*c*, testing may resume with a test in the option level testing 1814*c*. Transition 1808 represents that upon the occurrence of a failed test in the option level testing 1814*c*, testing may also resume with a test in the system level testing 1814*b*. Transition 18128 represents that upon the occurrence of a failed test in the option level testing 1814*c*, testing may also resume with a test in the instrument level testing 1814. As described herein, whether transition 1806, 1808 or 1812 occurs subsequent to an option level test failure may vary with the particular test failed and the remedial action(s) performed, if any. When option level testing of 181*c* has successfully completed, the installation processing transitions to the ending test state E. It should be noted that when transitioning from one of the testing sequence states 1814*a-c* to another different one of the testing sequence states 1814*a-c*, testing may resume with the first test in the different sequence or a particular test other than the first test in the sequence. For example, when transitioning 1810 from state 1814*b* to state 1814*a*, testing may resume with the first test in the instrument level testing sequence or another subsequent test in the sequence.

Figure 19:
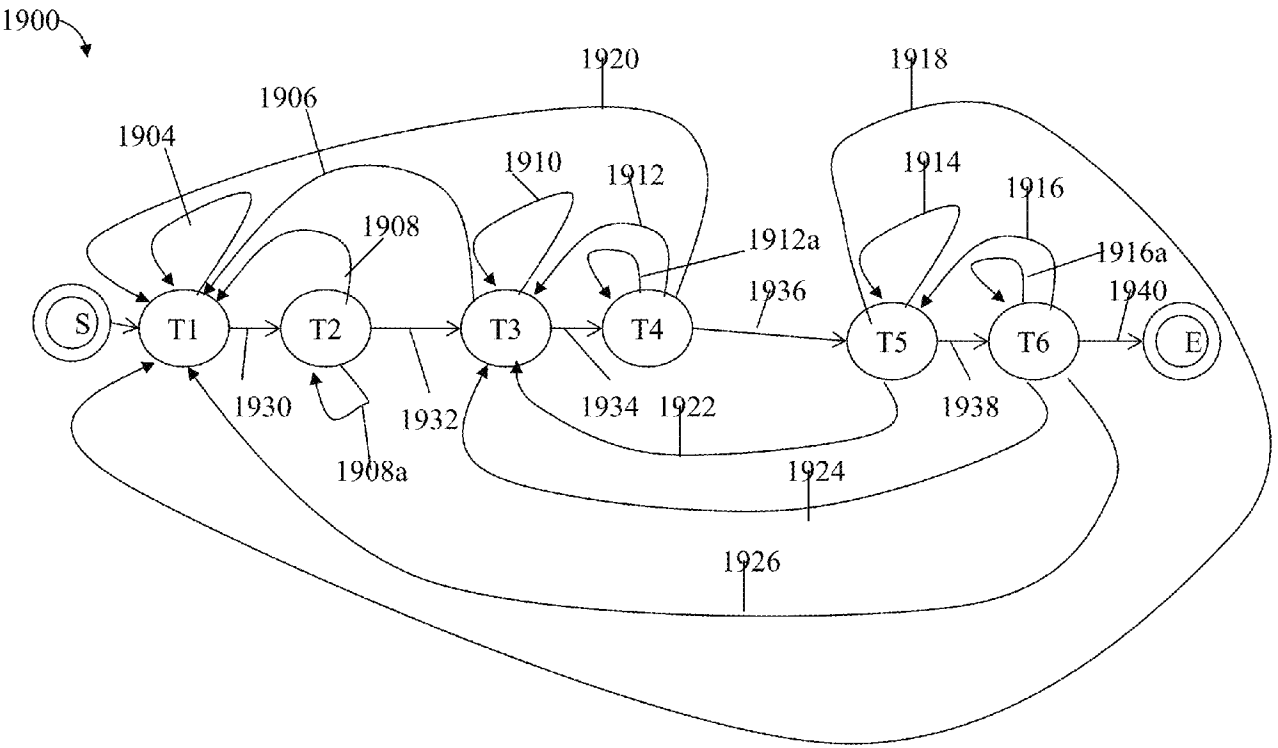

Referring to FIG. 19, shown is a more detailed example of state transitions that may occur in connection with testing of the installation processing as described herein such as in connection with FIG. 18. Conventions of FIG. 19 are similar to those as described above in connection with FIG. 18 with the difference that states of FIG. 19 correspond to individual tests rather than testing sequences as in FIG. 18. Transitions from a current state to the same state or another state representing a prior test may represent transitions that occur upon testing failure (e.g., failure of a test represented by the current state). Transitions from a current state to another state representing a subsequent test in the installation testing process represent transitions that occur upon successfully completing a test represented by the current state.

In the example 1900, T1 and T2 represent tests included in the MS instrument level testing, T3 and T4 represent tests included in the system level testing, and tests T5 and T6 represent tests included in the option level testing. Testing commences with T1 where upon failure of T1, transition 1904 indicates that testing remains in state T1. Upon successfully completing T1, transition 1930 represents that testing proceeds to T2. Upon failure of T2, transition 1908 represents that testing may resume with T1 and transition 1908*a* represents that testing may resume with T2. Upon successfully completing T2, transition 1932 represents that testing proceeds with test T3.

Upon failure of T3, transition 1910 represents that testing may resume with T3 and transition 1906 represents that testing may also resume with T1. Upon successfully completing T3, transition 1934 represents that testing proceeds with test T4. Upon failure of T4, transition 1912 represents that testing may resume with T3, transition 1912*a* represents that testing may resume with T4, and transition 1920 represents that testing may resume with T1 of the instrument level testing sequence. Upon successfully completing T4, transition 1936 represents that testing proceeds with test T5 of the option testing sequence.

Upon failure of T5, transition 1914 represents that testing may resume with T5, transition 1922 represents that testing may resume with T3 of the system level testing sequence, and transition 1918 represents that testing may resume with T1 of the instrument level testing sequence. Upon successfully completing T5, transition 1938 represents that testing proceeds with test T6. Upon failure of T6, transition 1916 represents that testing may resume with T5, transition 1916*a* represents that testing may resume with T6, transition 1924 represents that testing may resume with T3 of the system level testing sequence, and transition 1926 represents that testing may resume with T1 of the instrument level testing sequence. Upon successfully completing T6, transition 1940 represents that testing proceeds to installation testing completion as represented by the ending state E.

In connection with the testing transitions represented, for example, in FIG. 19, it should be noted that other transitions besides those are possible depending on the particular testing failure, remedial action, and the like. For example, upon failure of T6, an embodiment may also include a transition to resume testing with T4 or T2.

Use of the techniques herein for automated installation processing may provide benefits over, for example, manual installation testing. Generally, the time required to perform the test and collect and analyze test data may be reduced. Since the testing process is automated with tests performed in a prescribed enforced ordering and analysis such as comparison are automated, human aspects related to the foregoing are removed thereby providing a level of consistency of process and accuracy of results, from instrument to instrument. Additionally, a required level of knowledge or skill required to perform tests may be reduced due to the automation. Depending on the particular tests performed, installation testing may be performed without the need for an instrument-specific qualified engineer on site enabling further gains in process efficiency by identification of remedial work, extra maintenance work and parts required, etc., prior to an on-site visit by the engineer. For example, the tests such as those comprising a testing sequence of the installation processing may be initiated remotely from a technical support center at a different physical location from the MS system under test. The foregoing may be performed, for example, when the support center is working with a less-experienced individual onsite where the MS system is located. Although a technician may perform the manual setup activities at a customer installation site, the software controlling the sequence of installation tests, where to resume upon testing failure or in response to a remedial action performed, etc. may provide for initiation and control from a remote location offsite from where the MS system is installed. Software for performing and controlling the installation testing and processing may be remotely downloaded to the customer site or otherwise executed on a remote computer system where commands are issued from the remote system, such as over a computer communication network, to the MS system. Thus, the installation testing may be controlled and performed by another computer performing techniques herein where such computer is located remotely at a physically different location than the MS system under installation.

The techniques herein may be performed by executing code which is stored on any one or more different forms of computer-readable media. Computer-readable media may include different forms of volatile (e.g., RAM) and non-volatile (e.g., ROM, flash memory, magnetic or optical disks, or tape) storage which may be removable or non-removable.

Variations, modifications, and other implementations of what is described herein will occur to those of ordinary skill in the art without departing from the spirit and the scope of the invention as claimed. Accordingly, the invention is to be defined not by the preceding illustrative description but instead by the spirit and scope of the following claims.

What is claimed is:

1. A method of performing installation processing for installing a mass spectrometer, the method comprising:

executing software that controls an installation process of the mass spectrometer, wherein said executing software performs first processing including providing a user interface controlling a workflow of the installation process, wherein the workflow includes a predefined order of processing steps performed to complete the installation process, wherein, at a current point in the installation process, different user interface options performing associated processing steps of the installation process are disabled to enforce performing processing steps of the installation process in the predefined order;

completing one or more manual setup operations of the installation process in connection with physical installation of the mass spectrometer;

performing, as part of the installation process, instrument level testing of the mass spectrometer, wherein said instrument level testing includes automating execution of a first test sequence in response to a first user interface selection from the user interface controlling the workflow of the installation process, said first test sequence including one or more performance tests whereby mass spectral data characterizing observed performance of the mass spectrometer is compared to predetermined performance criteria; and performing, as part of the installation process, system level testing of functionality of the mass spectrometer in combination with one or more other components upon successful completion of said instrument level testing, wherein said system level testing includes automating execution of a second test sequence in response to a second user interface selection from the user interface controlling the workflow of the installation process, wherein said system level testing is performed after successful completion of said instrument level testing.

2. The method of claim 1, wherein after completing the one or more manual setup operations, the method further comprises performing processing including:

selecting one or more items from the user interface to indicate completion of the one or more manual setup operations;

selecting a third user interface selection after completing said selecting of the one or more items; and determining, in response to the third user interface selection, whether required manual setup operations have been completed based on which of said one or more items corresponding to one or more manual set up operations have been selected.

3. The method of claim 1, further comprising:

performing option level testing of one or more optional components of the mass spectrometer, wherein said option level testing is performed after successful completion of said system level testing.

4. The method of claim 3, wherein upon failure of an option test included in the option level testing, a remedial action is performed and the installation process resumes with testing at a point in any of the option level testing, the instrument level testing and the system level testing in accordance with the remedial action performed.

5. The method of claim 1, wherein each of the first test sequence and the second test sequence include any of an informational test and a critical threshold test.

6. The method of claim 5, wherein, responsive to a failure of a critical threshold test in any of the first test sequence and the second test sequence, the test sequence terminates, a remedial action in accordance with the failed critical threshold test is performed, and execution of the test sequence resumes with reperforming the failed critical threshold test or with reperforming another test previously successfully performed prior to the failed critical threshold test.

7. The method of claim 6, wherein a first test that is included in the test sequence and is subsequent to the critical threshold test in the test sequence generates first test results, said first test being dependent upon test results of the critical threshold test.

8. The method of claim 7, wherein validity of the first test results depends on having a successful test result of the critical threshold test.

9. The method of claim 1, wherein each of the first test sequence and the second test sequence specifies a predetermined order in which a plurality of tests are performed.

10. The method of claim 1, wherein a liquid chromatography instrument is coupled to the mass spectrometer and sample output from the liquid chromatography instrument is input to the mass spectrometer for analysis, wherein said system level testing includes testing functionality based on a combination of the liquid chromatography instrument and the mass spectrometer.

11. The method of claim 10, wherein said system level testing includes performing a gradient performance test whereby the liquid chromatography instrument varies concentrations of solvents during a first run and during a second run, the method further comprising:

comparing first mass spectral data acquired from the first run to second mass spectral data acquired during the second run;

determining whether any difference between the first mass spectral data and the second mass spectral data are within an acceptable threshold;

determining that the gradient performance test fails if any difference between the first and the second mass spectral data is not within the acceptable threshold, and otherwise determining that the gradient performance test passes.

12. The method of claim 11, wherein a first set of retention times of a plurality of compounds in the first mass spectral data are compared to a second set of corresponding retention times of the plurality of compounds in the second mass spectral data.

13. The method of claim 12, wherein if the gradient performance test fails, it is determined to take a remedial action on the liquid chromatography instrument and, subsequent to performing the remedial action, the system level testing resumes with reperforming the gradient performance test.

14. The method of claim 1, further comprising saving installation status information characterizing a current state of installation process for the mass spectrometer, said status information enabling resuming execution of the installation process at a subsequent point in time.

15. The method of claim 1, wherein the instrument level testing includes performing a performance test related to peak width and resolution, peak position indicating a mass position, and intensity.

16. The method of claim 1, wherein upon failure of a system level test included in the system level testing, a remedial action is performed, and the installation process resumes with testing at a point in any of the instrument level testing and the system level testing in accordance with the remedial action performed.

17. The method of claim 1, wherein commands to perform the system level testing and the instrument level testing are issued over a network connection to the mass spectrometer from a computer system remotely located with respect to the mass spectrometer.

18. The method of claim 1, wherein responsive to successful completion of the instrument level testing, a first user interface item selected in connection with the first user interface selection is disabled and a second user interface item selected in connection with the second user interface selection is enabled.

19. A non-transitory computer readable medium comprising code stored thereon that, when executed, performs a method of performing installation processing for installing a mass spectrometer comprising:

executing software that control an installation process of the mass spectrometer, wherein said executing software performs first processing including providing a user interface controlling a workflow of the installation process of the mass spectrometer wherein the workflow includes a predefined order of processing steps performed to complete the installation process, wherein, at a current point in the installation process, different user interface options performing associated processing steps of the installation process are disabled to enforce performing processing steps of the installation process in the predefined order;

indicating, via the user interface controlling the workflow of the installation process, that one or more manual setup operations of the installation process are to be completed in connection with physical installation of the mass spectrometer;

performing, as part of the installation process, instrument level testing of the mass spectrometer, wherein said instrument level testing includes automating execution of a first test sequence in response to a first user interface selection from the user interface controlling the workflow of the installation process, said first test sequence including one or more performance tests whereby mass spectral data characterizing observed performance of the mass spectrometer is compared to predetermined performance criteria; and performing, as of the installation process, system level testing of functionality of the mass spectrometer in combination with one or more other components upon successful completion of said instrument level testing, wherein said system level testing, includes automating execution of a second test sequence in response to a second user interface selection from the user interface controlling the workflow of the installation process, wherein said system level testing is performed after successful completion of said instrument level testing.

20. The non-transitory computer readable medium of claim 19, further comprising code that performs other processing after completing the one or more manual setup operations, the other processing comprising:

selecting one or more items from the user interface to indicate completion of the one or more manual setup operations;

selecting a third user interface selection after completing said selecting of the one or more items; and determining, in response to the third user interface selection, whether required manual setup operations have been completed based on which of said one or more items corresponding to one or more manual set up operations have been selected.

21. The non-transitory computer readable medium of claim 19, further comprising code that:

performs option level testing of one or more optional components of the mass spectrometer, wherein said option level testing is performed after successful completion of said system level testing.

22. A system comprising:

a processor; and a memory comprising a non-transitory computer readable medium including code stored therein that, when executed, performs a method of performing installation processing for installing a mass spectrometer comprising:

executing software that controls an installation process of the mass spectrometer, wherein said executing software performs first processing including providing a user interface controlling a workflow of the installation process, wherein the workflow includes a predefined order of processing steps performed to complete the installation process, wherein, at a current point in the installation process, different user interface options performing associated processing steps of the installation process are disabled to enforce performing processing steps of the installation process in the predefined order;

completing one or more manual setup operations of the installation process in connection with physical installation of the mass spectrometer;

performing, as part of the installation process, instrument level testing of the mass spectrometer, wherein said instrument level testing includes automating execution of a first test sequence in response to a first user interface selection from the user interface controlling the workflow of the installation process, said first test sequence including one or more performance tests whereby mass spectral data characterizing observed performance of the mass spectrometer is compared to predetermined performance criteria; and performing, as part of the installation process, system level testing of functionality of the mass spectrometer in combination with one or more other components upon successful completion of said instrument level testing, wherein said system level testing includes automating execution of a second test sequence in response to a second user interface selection from the user interface controlling the workflow of the installation process, wherein said system level testing is performed after successful completion of said instrument level testing.

* * * * *